US005368999A

United States Patent [19]

Makino

[11] Patent Number: 5,368,999

[45] Date of Patent: Nov. 29, 1994

[54] SILVER HALIDE EMULSION AND SILVER HALIDE PHOTOGRAPHIC LIGHT-SENSITIVE MATERIAL USING THE SAME

[75] Inventor: Katsumi Makino, Minami-Ashigara, Japan

[73] Assignee: Fuji Photo Film Co., Ltd., Kanagawa, Japan

[21] Appl. No.: 633,661

[22] Filed: Dec. 26, 1990

[30] Foreign Application Priority Data

Dec. 28, 1989 [JP] Japan ..... 1-343638

[51] Int. Cl.[5] ..... G03C 1/00; G03C 1/005

[52] U.S. Cl. ..... 430/569; 430/567; 430/603; 430/607; 430/611; 430/614

[58] Field of Search ..... 430/569, 567, 611, 607, 430/603, 614

[56] References Cited

U.S. PATENT DOCUMENTS

| | | | |
|---|---|---|---|
| 2,487,850 | 11/1949 | Carroll . | |
| 2,512,925 | 6/1950 | Eggeman . | |
| 2,518,698 | 8/1950 | Lowe et al. . | |
| 3,201,254 | 8/1965 | Reynolds et al. . | |
| 3,411,917 | 11/1968 | Figueras . | |
| 3,779,777 | 12/1973 | Bigelow . | |
| 3,930,867 | 1/1976 | Bigelow | 430/550 |
| 4,198,240 | 4/1980 | Mikawa | 430/570 |
| 4,276,374 | 6/1981 | Mifune et al. | 430/603 |
| 4,960,689 | 10/1990 | Nishikawa et al. | 430/605 |
| 5,061,614 | 10/1991 | Takada et al. | 430/569 |
| 5,079,138 | 1/1992 | Takada | 430/567 |
| 5,081,009 | 1/1992 | Tanemura et al. | 430/611 |

FOREIGN PATENT DOCUMENTS

| | | |
|---|---|---|
| 0348934 | 6/1989 | European Pat. Off. . |
| 0371338 | 11/1989 | European Pat. Off. . |

*Primary Examiner*—Thorl Chea

*Attorney, Agent, or Firm*—Birch, Stewart, Kolasch & Birch

[57] ABSTRACT

A silver halide emulsion contains light-sensitive silver halide grains in a binder. The silver halide emulsion is has been subjected to reduction-sensitization during grain formation and then added with at least one compound represented by the following formula (I), (II), or (III):

$$R—SO_2S—M \quad (I)$$

$$R—SO_2S—R_1 \quad (II)$$

$$R—SO_2S—L_m—SSO_2—R^2 \quad (III)$$

wherein R, $R^1$, and $R^2$ may be the same or different and represent an aliphatic group, an aromatic group, or a heterocyclic group, M represents a cation, L represents a divalent bonding group, and m represents 0 or 1. Compounds represented by formulas (I) to (III) may be polymers containing divalent groups derived from structures represented by formulas (I) to (III) as repeating unit. R, $R^1$, $R^2$, and L may be bonded to form a ring if possible.

12 Claims, No Drawings

SILVER HALIDE EMULSION AND SILVER HALIDE PHOTOGRAPHIC LIGHT-SENSITIVE MATERIAL USING THE SAME

BACKGROUND OF THE INVENTION

1. Field of the Invention

The present invention relates to a silver halide emulsion and to a silver halide photographic light-sensitive material using the emulsion, which has high sensitivity, high graininess, and improved storage stability.

2. Description of the Related Art

A recent technical movement of a silver halide color photographic light-sensitive material aims at providing a light-sensitive material which can be used as (1) a light-sensitive material having very high sensitivity such as a photographing light-sensitive material of ISO 1600 corresponding to needs of attaching importance to sensitivity or (2) a light-sensitive material having satisfactory graininess, sharpness, and color reproducibility even for use in photographing performed by a small-formatted camera such as a 110-size system or disc-size system.

A technique of increasing sensitivity of a silver halide emulsion has a great advantage in improvements in graininess since a grain size for obtaining a certain level of sensitivity can be decreased.

In order to increase the sensitivity of a silver halide emulsion it is required that, (1) the number of photons absorbed by a single grain is increased, (2) an efficiency of converting photoelectrons generated by light absorption into a silver cluster (latent image) is increased, and (3) development activity for effectively utilizing the obtained latent image is increased. Increasing the size increases the number of photons absorbed by a single grain but degrades image quality. Increasing the development activity is an effective means of increasing the sensitivity. In the case of parallel development such as color development, however, the graininess is generally degraded. In order to increase the sensitivity without degrading graininess, it is most preferable to increase the efficiency of converting photoelectrons into a latent image, i.e., increase a quantum efficiency. In order to increase the quantum efficiency, a low-efficiency process such as recombination and latent image dispersion must be minimized. It is known that a reduction sensitization method of forming a small silver nucleus without development activity inside or on the surface of a silver halide is effective to prevent recombination.

In addition, James et al. found that when a certain type of reduction sensitization in which a coated film of an emulsion subjected to gold-plus-sulfur sensitization is vacuum-deaerated and heat-treated in a hydrogen gas atmosphere is performed, sensitivity can be increased at a fog level lower than that in conventional reduction sensitization. This sensitizing method is well known as hydrogen sensitization and effective as a sensitivity increasing means in a laboratory scale. This hydrogen sensitization is actually used in the field of astrography.

The method of reduction sensitization has been studied for a long time. Carroll, Lowe et al., and Fallens et al. disclose that a tin compound, a polyamine compound, and a thiourea dioxide-based compound are effective as a reduction sensitizer in U.S. Pat. Nos. 2,487,850 and 2,512,925 and British Patent 789,823, respectively. Collier compares properties of silver nuclei formed by various reduction sensitization methods in "Photographic Science and Engineering", Vol. 23, P. 113 (1979). She adopted methods of dimethylamineborane, stannous chloride, hydrazine, high-pH ripening, and low-pAg ripening. Reduction sensitization methods are also disclosed in U.S. Pat. Nos. 2,518,698, 3,201,254, 3,411,917, 3,779,777, and 3,930,867. Not only selection of a reduction sensitizer but also improvements in a method of using the reduction-sensitizer are described in JP-B-57-33572 and JP-B-58-1410 ("JP-B-" means examined published Japanese patent application) and JP-A-57-179835 ("JP-A-" means unexamined published Japanese patent application).

Although these hydrogen sensitizing and reduction sensitizing techniques have a sensitizing effect, however, they also have the following drawbacks. That is, as pointed out in JP-A-57-115539, some or all of silver nuclei produced through a reducing environment are decomposed in an oxidizing environment. In addition, as pointed out in "Photographic Science and Engineering", Vol. 19, page 50, when an emulsion is left to stand in the air at room temperature after it is hydrogen-sensitized, its sensitivity is sometimes decreased while its fog is increased.

In addition, the fact that a sensitizing effect obtained by reduction sensitization is lost by a heat treatment is also reported. Proposals of eliminating these drawbacks are disclosed in JP-A-57-115539 and JP-A-60-178445, but these means have not reached a sufficient level. Furthermore, its improvement in storage stability is directed to prevent degradation in photographic properties caused by heating. Therefore, an improvement in storage stability at around room temperature for a long time period is especially insufficient.

SUMMARY OF THE INVENTION

It is an object of the present invention to provide a silver halide emulsion which has both high sensitivity and high graininess and is excellent in storage stability, i.e., in which photographic properties are not degraded (sensitivity is not decreased and fog is not increased) after the emulsion is stored under a heating condition or at around room temperature for a long time period.

It is another object of the present invention to provide a silver halide photographic light-sensitive material having high sensitivity, high graininess, and improved storage stability by using the above emulsion.

The above objects of the present invention can be achieved by the following means.

(1) A silver halide emulsion containing light-sensitive silver halide grains in a binder, wherein the silver halide emulsion has been subjected to reduction-sensitization during a grain formation step and then added with at least one compound represented by the following formula (I), (II), or (III):

$$R—SO_2S—M \quad (I)$$

$$R—SO_2S—R^1 \quad (II)$$

$$R—SO_2S—Lm—SSO_2—R^2 \quad (III)$$

wherein R, $R^1$, and $R^2$ may be the same or different and represent an aliphatic group, an aromatic group, or a heterocyclic group, M represents a cation, L represents a divalent bonding group, and m represents 0 or 1.

Compounds represented by formulas (I) to (III) may be polymers containing divalent groups derived from structures represented by formulas (I) to (III) as repeating units. In addition, R, $R^1$, $R^2$, and L may be bonded to form a ring if possible.

(2) The silver halide emulsion described in item (1) above, wherein at least one compound represented by formula (I), (II), or (III) is added after reduction sensitization is started and 80% of the total water-soluble silver salt required for the formation of silver halide grain are added.

(3) The silver halide emulsion described in item (1) above, wherein at least one compound represented by formula (I), (II), or (III) is added after grain formation is finished and before chemical sensitization is started.

(4) A silver halide photographic light-sensitive material having at least one silver halide emulsion layer on a support, wherein the emulsion layer contains at least one of silver halide emulsions described in items (1) to (3) above.

DETAILED DESCRIPTION OF THE INVENTION

The present invention will be described in detail below.

A silver halide emulsion manufacturing step is roughly classified into, e.g., grain formation, desalting, chemical sensitization, coating. The grain formation step is subdivided and further classified into, for example, nucleation, ripening, and preciptation substeps. These steps need not be sequentially performed but can be performed in a reverse order or repeatedly performed.

Reduction sensitization of the present invention is performed during grain formation. Reduction sensitization can be performed during any of nucleation as an initial stage of grain formation, physical ripening, and precipitation. Preferably, reduction sensitization is performed during precipitation of silver halide grains. This method of performing reduction sensitization during precipitation includes a method of performing reduction sensitization while silver halide grains are being grown by physical ripening or addition of water-soluble silver salt and a water-soluble alkali halide and a method of performing reduction sensitization during precipitation while growth is temporarily stopped and then precipitating again.

Reduction sensitization of the present invention can be selected from a method of adding a known reducing agent to a silver halide emulsion, a method called silver ripening in which precipitation or ripening is performed in a low-pAg atmosphere having a pAg of 1 to 7, and a method called high-pH ripening in which precipitation or ripening is performed in a high-pH atmosphere having a pH of 8 to 11. These methods can be used in combination of two or more thereof.

Reduction sensitization can also be performed by a method of adding a reduction sensitizer.

Examples of the reduction sensitizer are stannous salt, an amine and a polyamine, a hydrazine derivative, formamidinesulfinic acid, a silane compound, a borane compound, and an ascorbic acid derivative. In the present invention, these compounds can be selectively used in combination of two or more thereof.

As the reduction sensitizer, thiourea dioxide, dimethylamineborane, and the ascorbic acid derivative can be preferably used.

An addition amount of the reduction sensitizer must be selected in accordance with the emulsion manufacturing conditions. Generally, the addition amount is $10^{-7}$ to $10^{-2}$ mol per mol of a silver halide.

The reduction sensitizer can be dissolved in water or a solvent such as an alcohol, a glycol, a ketone, an ester, or an amide and then added during grain formation. Most preferably, the reduction sensitizer is added during grain growth. Although the reduction sensitizer can be added to a reactor vessel beforehand, it is more preferably added at an arbitrary timing during grain formation. In addition, the reduction sensitizer may be added to an aqueous solution of water-soluble silver salt or a water-soluble alkali halide, and the resultant solution may be used to perform grain formation. Furthermore, a solution of the reduction sensitizer may be added a plurality of times or continuously added over a long time period as grain formation progresses.

Of the above reduction sensitization methods, methods called high pH ripening and/or Ag ripening are preferred. In these methods, reduction sensitization is performed by changing a pH or pAg atmosphere. Therefore, execution of reduction sensitization can be controlled by changing the atmosphere.

An addition timing of a thiosulfonic acid compound (to be also referred to as simply a "thiosulfonate" hereinafter) represented by formula (I), (II), or (III) will be described below. The thiosulfonate may be added at any timing after reduction sensitization described above is started, e.g., at an arbitrary timing during a desalting step or at an arbitrary timing before chemical sensitization. When the thiosulfonate is to be added during grain formation, it is preferably added after reduction sensitization is started and 80% of total water-soluble silver salt required for grain formation are added and before a desalting step. More preferably, the thiosulfonate is added after reduction sensitization is started and 90% of total water-soluble silver salt are added and before the desalting step.

Most preferably, the thiosulfonate is added after reduction sensitization is started and grain formation is finished and before chemical sensitization is started. When the thiosulfonate is to be added during the desalting step, it may be added at an any time during the step as described above. "The thiosulfonate is preferably added before chemical sensitization" means that it is added before sensitizers such as gold sensitizers, sulfur sensitizers, and selenium sensitizers are added. When a sensitizing dye is to be added prior to chemical sensitization, the thiosulfonate is preferably added before the sensitizing dye is added. Preferably, the thiosulfonate is added after the grain formation is finished and before the desalting is started.

Thiosulfonic acid compounds represented by formulas (I), (II), and (III) will be described in more detail below. When R, $R^1$, and $R^2$ are each an aliphatic group, it is a saturated or unsaturated, straight-chain, branched or cyclic aliphatic hydrocarbon group and is preferably an alkyl group having 1 to 22 carbon atoms or an alkenyl group or alkinyl group having 2 to 22 carbon atoms. These groups may have a substituent group. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkinyl group are propargyl and butynyl.

An aromatic group of R, $R^1$, and $R^2$ includes a monocyclic or condensated-ring aromatic group and preferably has 6 to 20 carbon atoms. Examples of such an aromatic group are phenyl and naphthyl. These groups may have substituent group.

A heterocyclic group of R, $R^1$, and $R^2$ is a 3- to 15-membered ring, preferably, a 3- to 6-membered ring having at least one element of nitrogen, oxygen, sulfur, selenium, and tellurium and at least one carbon atom. Examples of the heterocyclic group are pyrrolidine, piperidine, pyridine, tetrahydrofurane, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of the substituent group of R, $R^1$, and $R^2$are an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and valeryl), a sulfonyl group (e.g., methylsulfonyl and phenylsulfonyl), an acylamino group (e.g., acetylamino and benzoylamino), a sulfonylamino group (e.g., methanesulfonylamino and benzenesulfonylamino), an acyloxy group (e.g., acetoxy and benzoxy), a carboxyl group, a cyano group, a sulfo group, an amino group, an $-SO_2SM$ (M is a monovalent cation) group, and an $-SO_2R^1$group.

A divalent bonding group represented by L is an atom or an atomic group containing at least one of C, N, S, and O. Examples of L are an alkylene group, an alkenylene group, an alkynylene group, an arylene group, —O—, —S—, —NH—, —CO—, and $-SO_2-$. These compounds can be used singly or in a combination of two or more thereof.

L is preferably a divalent aliphatic group or a divalent aromatic group. Examples of the divalent aliphatic group of L are $-(CH2)-n$ (n=1 to 12), $-CH_2-CH=CH-CH_2-$, $-CH_2C\equiv CCH_2-$,

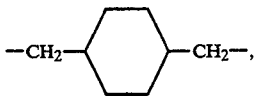

and a xylylene group. Examples of the divalent aromatic group of L are phenylene and naphthylene.

These substituent groups may be further substituted by the above-mentioned substituent groups.

M is preferably a metal ion or an organic cation. Examples of the metal ion are lithium ion, sodium ion, and potassium ion. Examples of the organic cation are ammonium ion (e.g., ammonium, tetramethylammonium, and tetrabutylammonium), a phosphonium ion (e.g. tetraphenylphosphonium), and a guanidil group.

When a compound represented by formula (I), (II), or (III) is a polymer, examples of its repeating unit are as follows:

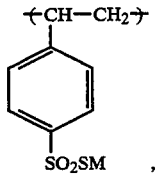

-continued

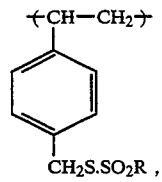

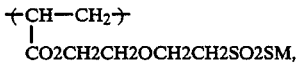

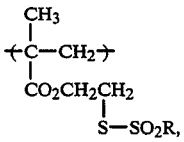

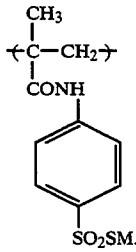

Each of the above polymers may be a homopolymer or a copolymer with another copolymerizable monomer.

Examples of compounds represented by formulas (I), (II), and (III) are listed in Table A. However, compounds are not limited to those in Table A.

Compounds represented by formulas (I), (II), and (III) can be easily synthesized by methods described or cited in JP-A-54-1019; British Patent 972,211; "Journal of Organic Chemistry", Vol. 53, page 396 (1988); and "Chemical Abstracts", Vol. 59, 9776e.

A compound represented by formula (I), (II), or (III) is preferably added in an amount of $10^{-7}$ to $10^{-1}$mol per mol of a silver halide. The addition amount is more preferably $10^{-6}$ to $10^{-2}$ mol/molAg and most preferably $10^{-5}$ to $10^{-3}$ mol/molAg.

A conventional method of adding an additive into a photographic emulsion can be adopted to add compounds represented by formulas (I) to (III) after reduction sensitization is started in a manufacturing process. For example, a water-soluble compound can be added in the form of an aqueous solution having an arbitrary concentration, and a water-insoluble compound or a compound which is hardly dissolved in water is dissolved in an arbitrary organic solvent such as alcohols, glycols, ketones, esters, and amides, which is miscible with water and does not adversely affect photographic properties, and then added as a solution. In addition, compounds (I) to (III) may be added to aqueous solutions of water-soluble silver salt or a water-soluble alkali halide, and these solutions may be used to perform grain formation. Furthermore, solutions containing compounds (I) to (III) may be added a plurality of times or continuously added over a long time period as grain formation progresses.

A compound most preferable in the present invention is represented by formula (I).

A silver halide emulsion to be used in the present invention can be selected from a regular crystal not including a twin plane and those described in Japan Photographic Society ed., "Silver Salt Photographs, Basis of Photographic Industries", (Corona Co., P. 163) such as a single twinned crystal including one twin face, a parallel multiple twinned crystal including two or more parallel twin planes, and a non-parallel multiple twinned crystal including two or more non-parallel twin planes in accordance with its application. In the case of a regular crystal, a cubic grain consisting of (100) faces, an octahedral grain consisting of (111) faces, and a dodecahedral grain consisting of (110) faces disclosed in JP-B-55-42737 and JP-A-60-222842 can be used. In addition, a grain consisting of (h11), e.g., (211) faces, a grain consisting of (hh1), e.g., (331) faces, a grain consisting of (hk0), e.g., (210) faces, and a grain consisting of (hkl), e.g., (321) faces as reported in "Journal of Imaging Science", Vol. 30, P. 247, 1986 can be selectively used in accordance with an application although a preparation method must be improved. A grain including two or more types of faces, e.g., a tetradecahedral grain consisting of both (100) and (111) faces, a grain consisting of both (100) and (110) faces, and a grain consisting of both (111) and (110) faces can be selectively used in accordance with an application.

The grain of a silver halide may be a fine grain having a grain size of 0.1 microns or less or a large grain having a projected area diameter of 10 microns. The emulsion may be a monodisperse emulsion having a narrow distribution or a polydisperse emulsion having a wide distribution.

A so-called monodisperse silver halide emulsion having a narrow size distribution, i.e., in which 80% or more (the number or weight of grains) of all grains fall within the range of ±30% of an average grain size. In order to satisfy target gradation of a light-sensitive material, two or more types of monodisperse silver halide emulsions having different grain sizes can be coated in a single layer or overlapped in different layers in emulsion layers having substantially the same color sensitivity. Alternatively, two or more types of polydisperse silver halide emulsions or a combination of monodisperse and polydisperse emulsions can be mixed or overlapped.

The photographic emulsions for use in the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, e.g., an acid method, a neutralization method, and an ammonia method. Also, as a system for reacting a soluble silver salt and a soluble halide, a single mixing method, a double mixing method, or a combination thereof can be used. Also, a so-called back mixing method for forming silver halide grains in the presence of excessive silver ions can be used. As one system of the double mixing method, a so-called controlled double jet method in which the pAg in the liquid phase wherein the silver halide is formed is kept at a constant value can be used. According to this method, a silver halide emulsion having a regular crystal form and almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, PP. 159–165 (1962); "Journal of Photographic Science", Vol. 12, 242–251 (1964); U.S. Pat. No. 3,655,394, and British Patent 1,413,748.

In the present invention, the following tabular grains are preferably used. That is, a tabular grain having a plurality of parallel twin plane, a tabular outer appearance, and an aspect ratio of 2 or more or a tabular grain having no twin plane and an aspect ratio of 2 or more can be used. The latter grain includes a rectangular grain as reported by A. Mignot et al. in "Journal of Cryst. Growth", Vol. 23, page 207 (1974).

An aspect ratio of a tabular grain used in the present invention means a ratio of a diameter to a thickness of a silver halide grain. That is, an aspect ratio is a value obtained by dividing a diameter of each silver halide grain by its thickness. In this case, a "diameter of a grain" means a diameter of a circle having an area equal to that of a projected area of the grain when a silver halide emulsion is observed by using a microscope or an electron microscope. Therefore, if an aspect ratio is 3 or more, the diameter of a circle is three times or more the thickness of a grain.

An average aspect ratio is calculated as follows. That is, 1,000 silver halide grains of an emulsion are extracted at random, and an aspect ratio of each grain is measured. Tabular grains corresponding to 50% of a total projected area are selected from those having higher aspect ratios and an arithmetic average of the aspect ratios of the selected tabular grains is calculated. An arithmetic average of diameters or thicknesses of the tabular grains used in calculation of the aspect ratio corresponds to an average grain size or an average grain thickness.

As an example of measuring an aspect ratio, a method of projecting to a transmission electron micrograph to obtain a circle-equivalent diameter and a thickness of each grain in accordance with a replica method is available. In this method, a thickness is calculated from a length of a shadow of a replica.

In the tabular silver halide grains used in the present invention, an average aspect ratio is 2.0 or more, preferably, 3 to 20, more preferably, 4 to 15, and most preferably, 5 to 10. A ratio occupied by tabular silver halide grains in a total projected area of all silver halide grains contained in one emulsion layer is preferably 50% or more, more preferably, 70% or more, and most preferably, 85% or more.

A silver halide photographic light-sensitive material having improved sharpness can be obtained by using the above emulsion. The sharpness is improved because a degree of light scattering caused by an emulsion layer using the emulsion as described above is much smaller than that caused by a conventional emulsion layer. This fact can be easily confirmed by an experiment normally used by those skilled in the art. Although the reason why a degree of light scattering in an emulsion layer using the tabular silver halide grains is small has not been clarified yet, it is assumed that surfaces of the tabular silver halide emulsion grains are oriented parallel to a support surface.

An average grain size of tabular silver halide grains which can used in the present invention and to which a thiosulfonic acid compound is added after reduction sensitization is performed is preferably 0.2 to 10.0 μm, more preferably, 0.3 to 5.0 μm, and most preferably, 0.4 to 3.0 μm. An average grain thickness is preferably 0.5 μm or less. More preferably, in a silver halide photographic emulsion, an average grain size is 0.4 to 3.0 μm, an average grain thickness is 0.5 μm or less, an average aspect ratio is 5 to 10, and 85% or more of a total projected area of all silver halide grains are occupied by tabular grains.

A grain size distribution may be either narrow or wide.

A tabular silver halide emulsion used in the present invention is reported by Cugnac or Chateau, or described in Duffin, "Photographic Emulsion Chemistry", (Focal Press, New York, 1966) pp. 66 to 72 or A. P. H. Trivelli, W. F. Smith ed., "Phot. Journal", 80 (1940), page 285. The emulsion can be easily prepared by methods described in, e.g., JP-A-58-113927, JP-A-58-113928, and JP-A-58-127921.

For example, a seed crystal in which 40% or more (weight) of tabular grains are present is formed in a comparatively high pAg atmosphere having a pBr of 1.3 or less, and silver and halogen solutions are simultaneously added to grow the seed crystal while substantially the same pBr value is maintained, thereby preparing an emulsion. In this grain growth process, the silver and halogen solutions are preferably added so as not to generate new crystal nuclei.

The size of tabular silver halide grains, which can used in the present invention and to which a thiosulfonic acid compound is added after reduction sensitization is performed, can be adjusted by adjusting a temperature, selecting the type or quality of solvent, and controlling addition rates of silver salt and a silver halide used in grain growth.

The tabular grain can be easily prepared by methods described in, for example, Cleve, "Photography Theory and Practice", (1930), P. 131; Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and a color sensitizing efficiency of a sensitizing dye can be advantageously improved as described in detail in U.S. Pat. No. 4,434,226.

The silver halide grain used in the present invention may consist of any of silver chloride, silver bromide, silver chlorobromide, silver iodobromide, and silver chloroiodobromide. More preferably, the silver halide grain consists of silver bromide, silver iodobromide containing 20 mol % or less of silver iodide, or silver chloroiodobromide containing 50 mol % or less of silver chloride and 2 mol % or less of silver iodide, and silver chlorobromide. A composition distribution in a mixed silver halide may be either uniform or localized.

A crystal structure may be uniform, may have different halogen compositions inside and outside a crystal, or may be layered structure. These emulsion grains are disclosed in, e.g., British Patent 1,027,146, U.S. Pat. Nos. 3,505,068 and 4,444,877, and Japanese Patent Application No. 58-248469. In addition, a silver halide having different compositions may be bonded by an epitaxial junction, or a compound other than a silver halide such as silver rhodanate or zinc oxide may be bonded.

When the silver halide emulsion of the present invention is a silver iodobromide emulsion and has a uniform structure with respect to a halogen composition, the emulsion preferably consists of silver iodobromide containing 20 mol % or less of silver iodide. A preferable silver iodide content changes in accordance with an application. For example, when an emulsion is required to have a high developing speed, a content of silver iodide is preferably 10 mol % or less, and more preferably, 5 mol % or less. In addition, when an emulsion is required to have soft gradation, an emulsion having a comparatively high silver iodide content is sometimes designed. In this case, the silver iodide content is preferably 5 mol % or more.

The silver halide emulsion of the present invention preferably has a distribution or structure of a halogen composition in its grain. A typical example is a core-shell type or double structured grain having different halogen compositions in the interior and surface layer of the grain as disclosed in, e.g., JP-B-43-13162, JP-A-61-215540, JP-A-60-222845, and JP-A-61-75337. In such a grain, the shape of a core portion is sometimes identical to or sometimes different from that of the entire grain with a shell. More specifically, while the core portion is cubic, the grain with a shell is sometimes cubic or sometimes octahedral. On the contrary, while the core portion is octahedral, the grain with a shell is sometimes cubic or sometimes octahedral. In addition, while the core portion is a clear regular grain, the grain with a shell is sometimes slightly deformed or sometimes does not have any definite shape. Furthermore, not a simple double structure but a triple structure as disclosed in JP-A-60-222844 or a multilayered structure of more layers can be formed, or a thin film of a silver halide having a different composition can be formed on the surface of a core-shell double structure grain.

In order to give a structure inside the grain, a grain having not only the above surrounding structure but a so-called junction structure can be made. Examples of such a grain are disclosed in, e.g., JP-A-59-133540, JP-A-58-108526, EP 199290A2, JP-B-58-24772, and JP-A-59-16254. A crystal to be bonded having a composition different from that of a host crystal can be bonded and grown to an edge, corner, or face portion of the host crystal. Such a junction crystal can be formed regardless of whether the host crystal has a homogeneous halogen composition or a core-shell structure.

The junction structure can be naturally made by a combination of silver halides. In addition, the junction structure can be made by combining a silver salt compound not having a rock salt structure, e.g., silver rhodanate or silver carbonate with a silver halide. A non-silver salt compound such as PbO can also be used as long as the junction structure can be made.

In silver iodobromide grains having the above structures, e.g., in a core-shell type grain, the silver iodide content may be high at a core portion and low at a shell portion or vice versa.

Also in the case of a grain having the structure in the silver iodide content, a preferable silver iodide content on the surface of the grain changes in accordance with an application. For example, when an emulsion is required to have a high developing speed, the silver iodide content in a portion close to the grain surface is preferably 10 mol % or less, and more preferably, 5 mol % or less. In addition, when an emulsion is required to have soft gradation, an emulsion having a comparatively high silver iodide content in a portion close to the grain surface is sometimes designed. In this case, the silver iodide content is preferably 5 mol % or more.

In order obtain a desired silver iodide content in a portion close to the grain surface, a silver iodide content in a shell portion may be adjusted to be a desired value, or a thin silver halide having a desired composition may be deposited on the surface of a grain.

Similarly, in the grain having the junction structure, a silver iodide content of a host crystal may be high while that of a bonded crystal is relatively low and vice versa.

In a grain having the above structure, a boundary portion between different halogen compositions may be clear or unclear due to a crystal mixture formed by a composition difference. Alternatively, a continuous structure change may be positively made.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

The silver halide emulsion for use in the present invention is preferably of a surface latent image type. An internal latent image type emulsion, however, can be used by selecting a developing solution or development conditions as disclosed in JP-A-59-133542. In addition, a shallow internal latent image type emulsion covered with a thin shell can be used in accordance with an application.

A silver halide solvent can be effectively used to promote ripening. For example, it is known that an excessive amount of halogen ions are supplied in a reaction vessel in order to promote ripening. Therefore, it is apparent that ripening can be promoted by only supplying a silver halide solution into a reaction vessel. In addition, another ripening agent can be used. In this case, a total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added in separate during step of adding a halide and a silver salt.

Examples of the ripening agent other than the halide ion are ammonia, an amine compound and a thiocyanate such as an alkali metal thiocyanate, especially sodium or potassium thiocyanate and ammonium thiocyanate.

The silver halide emulsion used in the present invention can be subjected to chemical sensitization such as sulfur sensitization and gold sensitization.

A portion to be subjected to the chemical sensitization differs in accordance with the composition, structure, or shape of an emulsion grain or an application of the emulsion. That is, a chemical sensitization nucleus is embedded either inside a grain or in a shallow portion from the grain surface or formed on the surface of a grain. Although the present invention is effective in any case, the chemical sensitization nucleus is most preferably formed in a portion near the surface. That is, the present invention is more effective in the surface latent image type emulsion than in the internal latent image type emulsion.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8 and a temperature of 30° to 80° C. by using sulfur, selenium, tellurium, gold, platinum, palladium or irridium, or a combination of a plurality of these sensitizers as described in Research Disclosure Vol. 120, No. 12,008 (April, 1974), Research Disclosure Vol. 34, No. 13,452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, a sulfur-containing compound described in U.S. Pat. Nos. 3,857,711, 4,266,018 and 4,054,457 or a sulfur-containing compound such as a hypo, thiourea compound and a rhodanine compound. Chemical sensitization can also be performed in the presence of a chemical sensitization assistant. An example of the chemical assistant is a compound known to suppress fogging and increase sensitivity in the chemical sensitization process such as azaindene, azapyridazine, and azapyrimidine. Examples of a chemical sensitization assistant modifier are described in U.S. Pat. Nos. 2,131,038, 3,411,914, 3,554,757, JP-A-58-126526 and G. F. Duffin, "Photographic Emulsion Chemistry", PP. 138 to 143.

The photographic emulsion for use in the present invention can contain various compounds in order to prevent fogging during manufacture, storage, or a photographic treatment of the light-sensitive material or to stabilize photographic properties. Examples of the compound known as an antifoggant or stabilizer are azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiazoles, aminotriazoles, benzotriazoles, nitrobenzotriazoles, and mercaptotetrazoles (especially, 1-phenyl-5-mercaptotetrazole); mercaptopyrimidines; mercaptotriadines; thioketo compounds such as oxadrinthione; azaindenes, e.g., triazaindenes, tetraazaindenes (especially, 4-hydroxy-substituted (1,3,3a,7)tetraazaindenes), and pentaazaindenes. Examples are described in U.S. Pat. Nos. 3,954,474 and 3,982,947 and JP-B-52-28660.

The photographic emulsion for use in the present invention can be subjected to spectral sensitization with, e.g., methine dyes. Examples of the dye are cyanine dye, merocyanine dye, complex cyanine dye, complex merocyanine dye, holopolar cyanine dye, hemicyanine dye, styryl dye, and hemioxonol dye. Most effective dyes are those belonging to cyanine dye, merocyanine dye, and complex merocyanine dye. In these dyes, any nucleus normally used as a basic heterocyclic nucleus in cyanine dyes can be used. Examples of the nucleus are pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; nucleus obtained by condensed alicyclic hydrocarbon ring to each of the above nuclei; and nucleus obtained by condensing an aromatic hydrocarbon ring to each of the above nuclei, e.g., indolenine nucleus, benzindolenine nucleus, indole nucleus, benzoxadole nucleus, naphthooxazole nucleus, benzothiazole nucleus, naphthothiazole nucleus, benzoselenazole nucleus, benzimidazole nucleus, and quinoline nucleus. These nuclei may be substituted on a carbon atom.

For a merocyanine dye or complex merocyanine dye, a 5- or 6-membered heterocyclic nucleus, e.g., pyrazoline-5-one nucleus, thiohydantoin nucleus, 2-thioxazolidine-2,4-dione nucleus, thiazolidine-2,4-dione nucleus, rhodanine nucleus, and thiobarbituric acid nucleus can be used as a nucleus having a ketomethylene structure.

These sensitizing dyes can be used singly or in a combination of two or more thereof. A combination of the sensitizing dyes is often used especially in order to perform supersensitization. Typical examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,708, British Patents 1,344,281 and 1,507,803, JP-B-43-110618, and JP-A-52-110618 and JP-A-52-109925.

The emulsion may contain, in addition to the sensitizing dye, a dye not having a spectral sensitizing effect or a substance substantially not absorbing visible light and having supersensitization.

The dye can be added in the emulsion at any time conventionally known to be effective in emulsion preparation. Most ordinarily, the dye is added after completion of chemical sensitization and before coating. However, the dye can be added at the same time as a chemical sensitizer to simultaneously perform spectral sensitization and chemical sensitization as described in U.S. Pat. Nos. 3,628,969 and 4,225,666, added before chemical sensitization as described in JP-A-58-113928, or added before completion of silver halide grain precipitation to start spectral sensitization. In addition, as described in U.S. Pat. No. 4,225,666, the above compound can be separately added such that a portion of the compound is added before chemical sensitization and the remaining portion is added thereafter. That is, as described in U.S. Pat. No. 4,183,756, the compound can be added at any time during silver halide grain formation.

An addition amount may be $4\times10^{-6}$ to $8\times10^{-3}$ mol per mol of a silver halide. More preferably, when a silver halide grain size is 0.2 to 1.2 μm, an addition amount of about $5\times10^{-5}$ to $2\times10^{-3}$ mol is more effective.

The above various additives can be used in the light-sensitive material of the present invention. In addition to the above additives, however, various additives can be used in accordance with the desired applications.

These additives are described in Research Disclosures, Item 17643 (Dec. 1978) and Item 18716 (Nov. 1979) and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In this invention, various color couplers can be used in the light-sensitive material. Specific examples of these couplers are described in above-described Research Disclosure, No. 17643, VII-C to VII-G as patent references.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-34659, and U.S. Pat. Nos. 4,500,630 and 4,540,654.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,211, and 4,367,282, and British Patent 2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, and U.S. Pat. No. 4,248,962.

Preferable examples of a coupler imagewise releasing a nucleating agent or a development accelerator upon development are those described in British Patent 2,097,140, 2,131,188, and JP-A-59-157638 and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound or DIR coupler releasing couplers, or DIR coupler releasing couplers or redox described in, e.g., JP-A-60-185950 and JP-A-62-24252; couplers releasing a dye which turns to a colored form after being released described in EP 173,302A; bleaching accelerator releasing couplers described in, e.g., RD. Nos. 11449 and 24241 and JP-A-61-201247; and a legand releasing coupler described in, e.g., U.S. Pat. No. 4,553,477.

The couplers for use in this invention can be introduced in the light-sensitive materials by various known dispersion methods.

Examples of a high-boiling solvent used in an oil-in-water dispersion method are described in, e.g., U.S. Pat. No. 2,322,027.

Examples of a high-boiling organic solvent to be used in the oil-in-water dispersion method and having a boiling point of 175° C. or more at normal pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, and bis(1,1-diethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), aniline derivatives (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an loadable latex are described in, e.g., U.S. Pat. No. 4,199,363 and west German Patent Application (OLS) Nos. 2,541,274 and 2,541,230.

The silver halide photographic light-sensitive material of the present invention has at least one silver halide emulsion layer on a support and can be applied to various types of color light-sensitive materials. Examples of the material are a color negative film for a general purpose or a movie, a color reversal film for a slide or a television, color paper, a color positive film, and color reversal paper.

When the present invention is used as a color material for photographing, the present invention can be applied to light-sensitive materials having various structures and to light-sensitive materials having combinations of layer structures and special color materials.

Typical examples are: light-sensitive materials in which characteristics of a coupling speed of a color coupler or diffusibility is combined with a layer structure, as disclosed in, e.g., JP-B-47-49031, JP-B-49-3843, JP-B-50-21248, JP-A-59-38147, JP-A-59-60437, JP-A-60-227256, JP-A-61-4043, JP-A-61-43743, and JP-A-61-42657; light-sensitive materials in which a single color-sensitive layer is divided into two or more layers, as disclosed in JP-B-49-15495 and U.S. Pat. No. 3,843,469; and light-sensitive materials, in which an arrangement of high- and low-sensitivity layers or layers having different color sensitivities is defined, as disclosed in JP-B-53-37017, JP-B-53-37018, JP-A-51-49027, JP-A-52-143016, JP-A-53-97424, JP-A-53-97831, JP-A-62-200350, and JP-A-59-177551.

Examples of a support suitable for use in this invention are described in the above-mentioned RD. No. 17643, page 28 and ibid., No. 18716, page 647, right column to page 648, left column.

The color photographic light-sensitive materials of this invention can be developed by the ordinary processes as described, for example, in the above-described Research Disclosure, No. 17643, pages 28 to 29 and ibid., No. 18716, page 651, left to right columns.

A color developer used in developing of the light-sensitive material of the present invention is an aqueous alkaline solution containing, as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. These compounds can be used in a combination of two or more thereof in accordance with applications.

In general, the color developer contains a pH buffering agent such as carbonate, borate or phosphate of alkali metal, and a development restrainer or antifoggant such as bromide, iodide, benzimidazoles, benzothiazoles or mercapto compound. If necessary, the color developer may also contain a preservative such as hydroxylamine, diethylhydroxylamine, sulfites, hydrazines, phenylsemicarbazides, triethanolamine, catechol sulfonic acids or triethylenediamine(1,4-diazabicyclo 2,2,2 octane)s; an organic solvent such as ethyleneglycol or diethyleneglycol; a development accelerator such as benzylalcohol, polyethyleneglycol, quaternary ammonium salts or amines; a dye forming coupler; a competing coupler; a fogging agent such as sodium boron hydride; an auxiliary developing agent such as 1-phenyl-3-pyrazolidone; a viscosity imparting agent; and a chelating agent such as an aminopolycarboxylic acid, an aminopolyphosphonic acid, an alkylphosphonic acid or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

When reversal development process is performed, generally, black-and-white development is performed and then color development is performed. As a black-and-white developer, known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more thereof.

The pH of the color and black-and-white developers is generally 9 to 12. Although a replenishment amount of the developer depends on a color photographic light-sensitive material to be processed, it is generally 3 liters or less per square meter of the light-sensitive material. The replenishment amount can be decreased to be 500 ml or less by decreasing a bromide ion concentration in a replenishing solution. When the replenishment amount is decreased, a contact area of a processing tank with air is preferably decreased to prevent evaporation and oxidation of the solution upon contact with air. The replenishment amount can be decreased by using a means capable of suppressing an accumulation amount of bromide ions in the developer.

A color development time is normally set between 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with applications. Examples of the bleaching agent are a compound of a multivalent metal such as iron (III), cobalt (III), chromium (VI) and copper (II); a peroxide; a quinone; and a nitro compound. Typical examples of the bleaching agent are ferricyanide; dichromate; organic complex salt of iron (III) or cobalt (III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, or a complex salt of citric acid, tartaric acid or malic acid; a persulfate; a bromate; a permanganate; and nitrobenzenes. Of these compounds, an iron (III) complex salt of aminopolycarboxylic acid such as an iron (III) complex salt of ethylenediaminetetraacetic acid, and a persulfate are preferred because they can increase a processing speed and prevent an environmental contamination. The iron (III) complex salt of aminopolycarboxylic acid is effective in both the bleaching and bleach-fixing solutions. The pH of the bleaching or bleach-fixing solution containing the iron (III) complex salt of aminopolycarboxylic acid is normally 5.5 to 8. In order to increase the processing speed, however, processing can be performed at a lower pH.

A bleaching accelerator can be used in the bleaching solution, the bleach-fixing solution and their pre-bath, if necessary. Effective examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426, and Research Disclosure No. 17,129 (July, 1978); thiazolidine derivatives described in JP-A-50-140129; thiourea derivatives described in JP-B-45-8506, JP-A-52-20832, JP-A-52-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506, and JP-A-58-163940; and bromide ion. Of these compounds, compounds having mercapto group or disulfide group are preferable since they have a great accelerating effect. In particular, compounds described in U.S. Pat. No. 3,893,858, West German Patent 1,290,812, and JP-A-53-95630 are preferable. A compound described in U.S. Pat. No. 4,552,834 is also preferable. These bleaching accelerators may be added in the light-sensitive material. These bleaching accelerators are effective especially in bleach-fixing of a color light-sensitive material for photographing.

Examples of the fixing agent are thiosulfates, thiocyanates, thioether-based compounds, thioureas and a large amount of iodide. Of these compounds, thiosulfates, especially, ammonium thiosulfate can be used in a widest range of applications. As a preservative of the bleach-fixing solution, sulfites, bisulfites or carbonyl bisulfite adducts is preferred.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi, "Chemistry of Antibacterial and Antifungal Agents", Eiseigijutsu-Kai ed., "Sterilization, Antibacterial, and Antifungal Techniques for Microorganisms", and Nippon Bokin Bokabi Gakkai ed., "Dictionary of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing formalin and a surface-active agent to be used as a final bath of the color light-sensitive material for photographing. Various chelating agents or antifungal agents can be added in the stabilizing bath.

An overflow solution produced upon washing and/or replenishment of the stabilizing solution can be reused in another step such as a desilvering step.

The silver halide color light-sensitive material of the present invention may contain a color developing agent in order to simplify processing and increase a processing speed. For this purpose, various types of precursors of color developing agents are preferably used. Examples of the precursor are an indoaniline-based compound described in U.S. Pat. No. 3,342,597, Schiff base compounds described in U.S. Pat. No. 3,342,599 and Research Disclosure Nos. 14,850 and 15,159, an aldol compound described in Research Disclosure No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a high temperature to shorten a processing time, or image quality or stability of a processing solution may be improved at a lower temperature. In order to save silver for the light-sensitive material, processing using cobalt intensification or hydrogen peroxide intensification described in West German Patent No. 2,226,770 or U.S. Pat. No. 3,674,499 may be performed.

The silver halide light-sensitive material of the present invention can also be applied to thermal development light-sensitive materials described in, e.g., U.S. Pat. No. 4,500,626, JP-A-60-133449, JP-A-59-218443, JP-A-61-238056, and EP 210,660A2.

When the light-sensitive material of the present invention is to be used in the form of roll, it is preferably housed in a cartridge. A most general type of the cartridge is a currently used 135-format. In addition, cartridges proposed in patents to be enumerated below can be used. JU-B-58-67329, JP-A-58-181035, JP-A-58-182634, JU-B-58-195236, U.S. Pat. No. 4,221,479, JP-A-01-231045, JP-A-02-124564, JP-A-02-170156, Japanese Patent Application Nos. 1-21862, 1-25362, 1-30246, 1-20222, 1-21863, 1-37181, 1-33108, 1-85198, 1-172593, 1-172594, and 1-172595, and U.S. Pat. Nos. 4,846,418, 4,848,693, and 4,832,275.)

The present invention will be described in detail below by way of its examples, but the present invention is not limited to these examples.

EXAMPLE 1

In Example 1, examples of emulsions comprising regular crystals will be described.

Preparation of Emulsion A 40 g of inert gelatin and 1.0 g of potassium bromide were dissolved in 1.0 l of distilled water, and 232 cc of an aqueous solution containing 10 g of silver nitrate were added to the resultant solution under stirring at 65° C. over 7 minutes while 226 cc of an aqueous solution containing 7.7 g of potassium bromide and 0.3 g of potassium iodide were added in order to maintain a pBr of 3.6 (first addition). Subsequently, 500 cc of an aqueous solution containing 90 g of silver nitrate were added to the resultant solution mixture over 20 minutes while 520 cc of an aqueous solution containing 67 g of potassium bromide and 1 g of potassium iodide were added in order to maintain a pBr of 3.6 (second addition).

A desalting step was started five minutes after the addition, and a sensitizing dye A (represented by a formula presented in the end of Example 1) was added in an amount of $8\times10^{-4}$ mol per mol of silver nitrate at 60° C. after the desalting step was finished, and gold-plus-sulfur sensitization was optimally performed.

Preparation of Emulsion B

An emulsion B was prepared following the same procedures as for the emulsion A except that:

immediately before (10 seconds before) the second addition was started in the emulsion A, ascorbic acid was added in an amount of $1\times10^{-3}$ mol per mol of silver nitrate for use in grain formation.

Preparation of Emulsion C

An emulsion C was prepared following the same procedures as for the emulsion A except that:

immediately before (10 seconds before) the second addition was started in the emulsion A, ascorbic acid was added in an amount of $1\times10^{-3}$ mol per mol of silver nitrate for use in grain formation; and immediately before the second addition was started, a thiosulfonic compound represented by formula (1-2) in Table A was added, simultaneously with ascorbic, in an amount of $5\times10^{-5}$ mol per mol of silver nitrate for use in grain formation.

Preparation of Emulsion D

An emulsion D was prepared following the same procedures as for the emulsion C except that:

the thiosulfonic acid compound was added 11 minutes after the second addition was started in the emulsion C.

Preparation of Emulsion E

An emulsion E was prepared following the same procedures as for the emulsion C except that:

the thiosulfonic acid compound was added 18 minutes after the second addition was started in the emulsion C.

Preparation of Emulsion F

An emulsion F was prepared following the same procedures as for the emulsion C except that:

the thiosulfonic acid compound was added immediately after (10 seconds after) the second addition was finished in the emulsion C.

Each of the emulsions A to F contained cubic grains having an average circle-equivalent diameter of 0.2 μm and a variation coefficient of 10%.

The emulsions A to F were coated to form samples 101 to 106 as follows.

Formation of Sample 101

An emulsion layer and a protective layer having the following compositions were coated on a triacetylcellulose film support having an undercoating layer.

| | |
|---|---|
| Emulsion layer | |
| Emulsion A of silver halide grains silver coating amount | 0.8 g/m$^2$ |
| Coupler A | 0.8 g/m$^2$ |
| Tricresylphosphate | 0.25 g/m$^2$ |
| Gelatin | 1.4 g/m$^2$ |
| Protective layer | |
| Gelatin | 2.5 g/m$^2$ |
| Hardener | 0.35 g/m$^2$ |

-continued $CH_2{=}CHSO_2CH_2CONH{-}CH_2$
$\quad\quad\quad

Preparation of Emulsion G 21 g of inert gelatin and 7.0 g of potassium bromide were dissolved in 1.4 l of distilled water, and 70 cc of an aqueous solution containing 12.0 g of silver nitrate and 70 cc of an aqueous solution containing 8.0 g of potassium bromide and 0.5 g of potassium iodide were simultaneously added by a double jet method at constant flow rates over 45 seconds (first addition). 220 g of a 10% solution of inert gelatin were added to the resultant solution, and the solution was heated up to 65° C. 30 minutes after the temperature reached 65° C., 434 cc of an aqueous solution containing 130 g of silver nitrate were added over 35 minutes while 700 cc of an aqueous solution containing 200 g of potassium bromide and 4.3 g of potassium iodide were used to maintain a pBr of 2.3 (second addition).

After the second addition was finished, 6.0 cc of 1-N solution of potassium thiocyanate were added to the resultant solution. Two minutes after the addition, 317 cc of an aqueous solution containing 95 g of silver nitrate were added over 20 minutes while 700 cc of an aqueous solution containing 200 g of potassium bromide and 4.3 g of potassium iodide were used to maintain a pBr of 2.3 (third addition).

A desalting step was started 10 minutes after the addition, and the sensitizing dye A described in Example 1 was added in an amount of $6\times10^{-4}$ mol per mol of silver nitrate at 60° C. after the desalting step was finished. Thereafter, gold-plus-sulfur sensitization was optimally performed.

Preparation of Emulsion H

An emulsion H was prepared following the same procedures as for the emulsion G except that:

1-N NaOH solution was used to adjust a pH of a reaction solution in a tank to be 9.2, one minute before the second addition was started in the emulsion G.

Preparation of Emulsion I

An emulsion I was prepared following the same procedures as for the emulsion H except that:

a thiosulfonic acid compound represented by formula (1-5) in Table A was added, simultaneoulsy with 1-N NaOH, in an amount of $1\times10^{-4}$ mol per mol of silver nitrate for use in grain formation, one minute before the second addition was started in the emulsion H.

Preparation of Emulsion J

An emulsion J was prepared following the same procedures as for the emulsion I except that:

the thiosulfonic acid compound was added one minute before the third addition was started in the emulsion I.

Preparation of Emulsion K

An emulsion K was prepared following the same procedures as for the emulsion I except that:

the thiosulfonic acid compound was added 15 minutes after the third addition was started in the emulsion I.

Preparation of Emulsion L

An emulsion L was prepared following the same procedures as for the emulsion I except that:

the thiosulfonic acid compound was added immediately after (10 seconds after) the third addition was finished in the emulsion I.

The emulsions G to L each contained tabular grains having an average circle-equivalent diameter of 0.60 μm, an average aspect ratio of 4.0, and a variation coefficient of a circle-equivalent diameter of 25%.

The emulsions G to L were coated to prepare samples 201 to 206 as follows.

Preparation of Sample 201

An emulsion layer and a protective layer having the following compositions were coated on a triacetylcellulose film support having an undercoating layer.

| | |
|---|---|
| Emulsion layer | |
| Emulsion G of silver halide grains silver coating amount | 0.76 g/m$^2$ |
| Coupler A (described in Example 1) | 1.00 g/m$^2$ |
| Coupler B | 0.15 g/m$^2$ |
| Coupler C | 0.12 g/m$^2$ |
| Tricresylphosphate | 0.40 g/m$^2$ |
| Gelatin | 2.0 g/m$^2$ |
| Protective layer | |
| Gelatin | 2.5 g/m$^2$ |
| Film hardener | 0.35 g/m$^2$ |

$$\begin{array}{l} CH_2{=}CHSO_2CH_2CONH{-}CH_2 \\ \qquad\qquad\qquad\qquad\quad | \\ CH_2{=}CHSO_2CH_2CONH{-}CH_2 \end{array}$$

Preparation of Samples 202 to 206

The emulsion of the sample 201 was changed to the emulsions H to L to form samples 202 to 206, respectively.

The samples 201 to 206 were left to stand at a temperature of 40° C. and a relative humidity of 70% for 14 hours, and then subjected to sensitmetry exposure (1/100") and the color development process described in Example 1.

The processed samples were subjected to density measurement by using a blue filter. The measurement results are summarized in Table 2.

In addition, another two sets of the samples 201 to 206 left to stand at a temperature of 40° C. and a relative humidity of 70% for 14 hours were prepared. One set of the samples was left to stand at a temperature of 25° C. and a relative humidity of 60% for 12 months. Another set of the samples was left to stand at a temperature of 60° C. and a relative humidity of 60% for 7 days. These samples were subjected to sensitmetry exposure (1/100") and the color development process as described in Example 1.

The processed samples were subjected to density measurement by using a blue filter. The measurement results are also summarized in Table 2.

Of the photographic properties described above, sensitivity is represented by relative sensitivity assuming that the sensitivity of the sample 201 is 100.

As is apparent from Table 2, even when tabular grains are used, each emulsion of the present invention subjected to reduction sensitization (high pH ripening) has high sensitivity and improved storage stability at around room temperature for a long time period or upon application of heat and humidity.

TABLE 2

| Sample No. | 40° C., 70%, 14 Hours Fog | Sensitivity | 25° C., 60%, 12 Months Fog | Sensitivity | 60° C., 60%, 7 Days Fog | Sensitivity |
|---|---|---|---|---|---|---|
| Sample 201 (Comparative Example) | 0.15 | 100 | 0.21 | 76 | 0.31 | 81 |
| Sample 202 (Comparative Example) | 0.35 | 125 | 0.43 | 74 | 0.51 | 78 |
| Sample 203 (Comparative Example) | 0.15 | 102 | 0.20 | 79 | 0.33 | 83 |
| Sample 204 (Present Invention) | 0.15 | 132 | 0.18 | 116 | 0.25 | 121 |
| Sample 205 (Present Invention) | 0.16 | 155 | 0.18 | 145 | 0.25 | 155 |
| Sample 206 (Present Invention) | 0.16 | 163 | 0.18 | 157 | 0.25 | 163 |

Coupler B

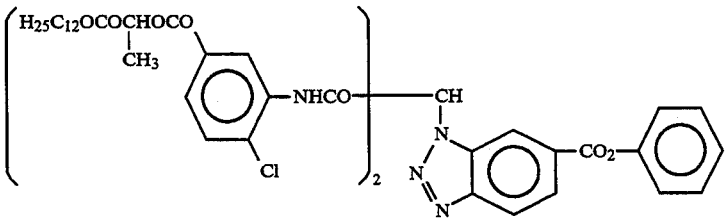

Coupler C

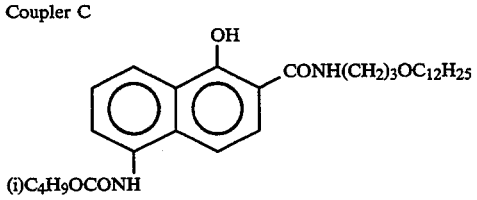

EXAMPLE 3

In Example 3, examples of emulsions comprising tabular grains having a large size will be described by taking a multilayered color light-sensitive material as an example.

Preparation of Emulsion M 25 cc of a 2-M aqueous silver nitrate solution containing gelatin and 25 cc of a 2-M aqueous potassium bromide solution containing gelatin were simultaneously mixed in 1 l of 0.7-wt % gelatin solution containing 0.04-M potassium bromide under strong stirring over one minute. Thereafter, the resultant mixture was heated up to 75° C., and 300 cc of a 10-wt % gelatin solution were added. 30 cc of a 1-M aqueous silver nitrate solution were added to the resultant solution over 5 minutes, and 10 cc of 25-wt % aqueous ammonia were added to perform ripening at 75° C. The ammonia was neutralized after ripening was finished, and then 1-M aqueous silver nitrate solution and 1-M potassium bromide solution were simultaneously mixed at an accelerated flow rate (a flow rate at the end of mixing was five times that at the beginning, while a pBr was maintained at 2.3 (An amount of the used aqueous silver nitrate solution was 600 cc).

The resultant emulsion was washed with water by a conventional flocculation method, and dispersion gelatin was added to the emulsion, thereby preparing 800 g of a hexagonal tabular silver halide emulsion (seed emulsion-A).

This seed emulsion-A comprised monodisperse hexagonal tabular grains having an average circle-equivalent diameter based on projected area (grain size) of 1.0 μm, an average thickness of 0.18 μm, and a variation coefficient of 11%. The formation of the seed emulsion-A is regarded as first addition.

Subsequently, 800 cc of distilled water, 30 g of gelatin, and 6.5 g of potassium bromide were added to 250 g of the seed emulsion-A, and the resultant emulsion was heated up to 75° C. A 1-M aqueous silver nitrate solution and a 1-M aqueous alkali halide solution (in which 10 mol % of potassium iodide were mixed with respect to 90 mol % of potassium bromide) were simultaneously mixed at an accelerated flow rate (a flow rate at the end of mixing was three times that at the beginning) in the resultant emulsion under stirring, while the pBr was maintained at 1.6. An amount of the used aqueous silver nitrate solution was 600 cc (second addition). In addition, a 1-M aqueous silver nitrate solution and a 1-M aqueous potassium bromide solution were simultaneously mixed at an accelerated flow rate ia flow rate at the end of mixing was 1.5 times that at the beginning), while the pBr was maintained at 1.6. An amount of the used aqueous silver nitrate solution was 200 cc (third addition).

The resultant emulsion was washed with water by the above method, and dispersion gelatin was added to prepare a monodisperse hexagonal tabular silver halide emulsion (emulsion M). In the prepared emulsion M, 92% of a total projected area were occupied by hexagonal tabular grains having an average grain size of 1.75 μm, an average thickness of 0.29 μm, an average aspect ratio of 6:1, and a variation coefficient of 16%.

Preparation of Emulsion N

An emulsion N was prepared following the same procedures as for the emulsion M except that:

1-N NaOH was used to adjust a pH of a reaction solution in a tank to be 9.2, thirty seconds before the second addition to the seed crystal-A was started.

Preparation of Emulsion O

An emulsion O was prepared following the same procedures as for the emulsion M except that:

a thiosulfonic acid compound represented by formula I-2 shown in Table A was added in an amount of $7\times10^{-5}$ mol per mol of silver nitrate for use in grain formation, simultaneously with 1-N NaOH 30 seconds before the second addition to the seed crystal-A was started.

Preparation of Emulsion P

An emulsion P was prepared following the same procedures as for the emulsion O except that:

the thiosulfonic acid compound was added when 400 cc of the 1-M aqueous silver nitrate solution were added after the second addition was started in the emulsion O.

Preparation of Emulsion Q

An emulsion Q was prepared following the same procedures as for the emulsion O except that:

the thiosulfonic acid compound was added when 100 cc of the 1-M aqueous silver nitrate solution were added after the third addition was started in the emulsion O.

Preparation of Emulsion R

An emulsion R was prepared following the same procedures as for the emulsion O except that:

the thiosulfonic acid compound was added 10 seconds after the third addition was finished and before washing was performed in the emulsion O.

The emulsions N to R each had exactly the same average grain size, average aspect ratio, and variation coefficient as those of the emulsion M.

The following spectral sensitizing dye S-1 (blue-sensitive dye) was added to the emulsions M to R in an amount corresponding to 80% of a saturated adsorption amount of each emulsion, and the emulsions were left to stand at 60° C. for 20 minutes. Thereafter, chemical sensitization was optimally performed at a temperature of 60° C. and a pH of 6.5 by using sodium thiosulfate, chloroauric acid, and potassium thiocyanate, thereby preparing emulsions M-1 to R-1.

S-1

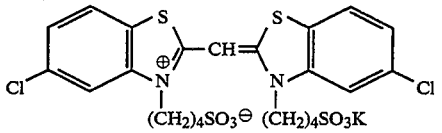

A mixture of the following spectral sensitizing dyes S-2, S-3, and S-4 (green-sensitive dyes) mixed at a ratio of 1.0:2.3:8.5 (molar ratio) was added to the emulsions M to R in an amount corresponding to 95% of a saturated adsorption amount of each emulsion, and the emulsions were left to stand at 60° C. for two minutes. Thereafter, chemical sensitization was optimally performed at a temperature of 60° C. and a pH of 6.5 by using sodium thiosulfate, chloroauric acid, and potassium thiocyanate, thereby preparing emulsions M-2 to R-2.

S-2

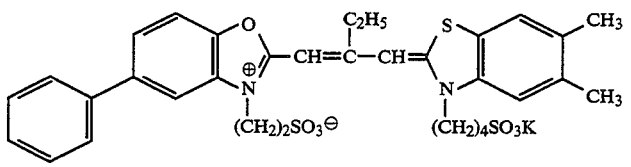

S-3

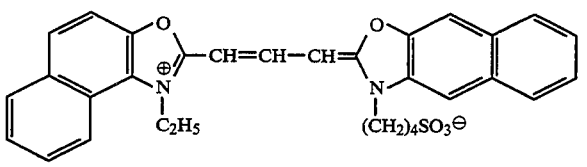

S-4

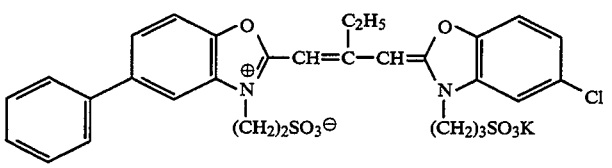

A mixture of the following spectral sensitizing dyes S-5, S-6, S-7, and S-8 (red-sensitive dyes) mixed at a mixing ratio of 4.0:1.0:17.0:2.5 (molar ratio) was added to the emulsions M to R in an amount corresponding to 95% of a saturated adsorption amount of each emulsion, and the emulsions were left to stand at 60° C. for two minutes. Thereafter, chemical. sensitization was optimally performed at a temperature of 60° C. and a pH of 6.5 by using sodium thiosulfate, chloroauric acid, and potassium thiocyanate, thereby preparing emulsions M-3 to R-3.

S-5

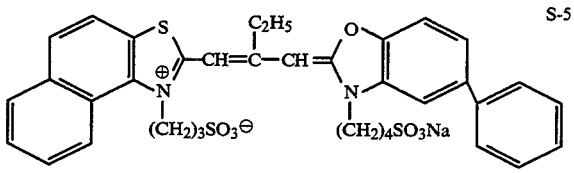

-continued

S-6

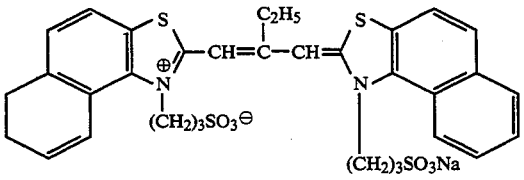

S-7

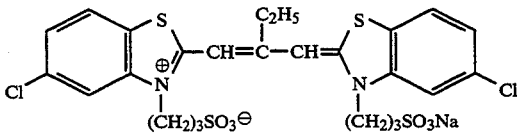

S-8

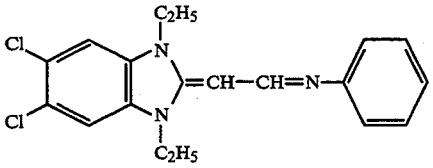

Using these emulsions, multilayered color light-sensitive materials comprising coated layers having the following compositions on an undercoated triacetylcellulose film support, were manufactured.

Compositions of Light-Sensitive Layers

The coating amounts of a silver halide and colloid silver are represented in units of g/m$^2$ of silver, that of couplers, additives, and gelatin is represented in units of g/m$^2$, and that of sensitizing dyes is represented by the number of mols per mol of the silver halide in the same layer.

| | |
|---|---|
| Layer 1: Antihalation layer | |
| Black colloid silver | 0.2 |
| coating silver amount | |
| Gelatin | 2.2 |
| UV-1 | 0.1 |
| UV-2 | 0.2 |
| Cpd-1 | 0.04 |
| Cpd-2 | 0.02 |
| Solv-1 | 0.30 |
| Solv-2 | 0.01 |
| Layer 2: Interlayer | |
| Fine silver iodobromide grain (AgI = 1.0 mol %, sphere-equivalent diameter = 0.07 μm) | 0.15 |
| coating silver amount | |
| Gelatin | 1.0 |
| ExC-4 | 0.03 |
| Cpd-3 | 0.2 |
| Layer 3: 1st red-sensitive emulsion layer | |
| Silver iodobromide emulsion (AgI = 5.0 mol %, surface high AgI type, sphere-equivalent diameter = 0.9 μm, variation coefficient of sphere-equivalent diameter = 21%, tabular grain, diameter/thickness ratio = 7.5) | 0.42 |
| coating silver amount | |
| Silver iodobromide emulsion (AgI = 4.0 mol %, internally high AgI type, sphere-equivalent diameter = 0.4 μm, variation coefficient of sphere-equivalent diameter = 18%, tetradecahedral grain) | 0.40 |
| coating silver amount | |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExC-1 | 0.50 |
| ExC-2 | 0.11 |
| ExC-3 | 0.009 |
| ExC-4 | 0.023 |
| Solv-1 | 0.24 |
| Layer 4: 2nd red-sensitive emulsion layer | |
| Silver iodobromide emulsion (AgI = 8.5 mol %, internally high AgI type, sphere-equivalent diameter = 1.0 μm, variation coefficient of sphere-equivalent diameter = 25%, tabular grain, diameter/thickness ratio = 3.0) | 0.85 |
| coating silver amount | |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExC-1 | 0.10 |
| ExC-2 | 0.05 |
| ExC-4 | 0.025 |
| Solv-1 | 0.10 |
| Layer 5: 3rd red-sensiive emulsion layer | |
| Silver iodobromide emulsion I | 1.50 |
| coating silver amount | |
| Gelatin | 0.6 |
| ExC-2 | 0.08 |
| ExC-4 | 0.01 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Solv-1 | 0.1 |
| Layer 7: 1st green-sensitive emulsion layer | |
| Silver iodobromide emulsion (AgI = 5.0 mol, % surface high AgI type, sphere-equivalent diameter = 0.9 μm, variation coefficient of sphere-equivalent diameter = 21%, tabular grain, diameter/thickness ratio = 7.0) | 0.28 |
| coating silver amount | |
| Silver iodobromide emulsion (AgI = 40 mol %, internally high AgI type, sphere-equivalent diameter = 0.4 μm, tetradecahedral grain, variation coefficient of sphere-equivalent diameter = 18%) | 0.16 |
| coating silver amount | |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.50 |
| ExM-2 | 0.10 |
| ExM-5 | 0.03 |
| Solv-1 | 0.2 |
| Solv-4 | 0.03 |
| Layer 8: 2nd green-sensitive emulsion layer | |
| Silver iodobromide emulsion (AgI = 8.5 mol %, internally high iodide type, sphere-equivalent diameter = 1.0 μm, variation coefficient of sphere-equivalent diameter = 25%, tabular grain, diameter/thickness ratio = 3.0) | 0.57 |
| coating silver amount | |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.12 |
| ExM-2 | 0.01 |
| ExM-3 | 0.03 |
| Solv-1 | 0.15 |
| Solv-4 | 0.03 |
| Layer 9: Interlayer | |
| Gelatin | 0.5 |
| Solv-1 | 0.02 |
| Layer 10: 3rd green-sensitive emulsion layer | |
| Silver iodobromide emulsion II | 1.3 |
| coating silver amount | |
| Gelatin | 0.8 |
| ExM-4 | 0.04 |
| ExC-4 | 0.005 |
| ExM-6 | 0.01 |
| Cpd-5 | 0.01 |
| Solv-1 | 0.2 |

-continued

| | |
|---|---|
| Layer 11: Yellow filter layer | |
| Cpd-6 | 0.05 |
| Gelatin | 0.5 |
| Solv-1 | 0.1 |
| Layer 12: Interlayer | |
| Gelatin | 0.5 |
| Cpd-3 | 0.1 |
| Layer 13: 1st blue-sensitive emulsion layer | |
| Silver iodobromide emulsion (AgI = 2 mol %, homogeneous iodide type, sphere-equivalent diameter = 0.55 μm, tabular grain, diameter/thickness ratio = 7.0, variation coefficient of sphere-equivalent diameter = 25%) coating silver amount | 0.2 |
| Gelatin | 1.0 |
| ExS-8 | $3 \times 10^{-4}$ |
| ExY-1 | 0.6 |
| ExY-2 | 0.02 |
| Solv-1 | 0.15 |
| Layer 14: 2nd blue-sensitive emulsion layer | |
| Silver iodobromide emulsion (AgI = 19.0 mol %, internally high AgI type, sphere-equivalent diameter = 1.0 μm, variation coefficient of sphere-equivalent diameter = 16%, octahedral grain) coating silver amount | 0.19 |
| Gelatin | 0.3 |
| ExS-8 | $2 \times 10^{-4}$ |
| ExY-1 | 0.22 |
| Solv-1 | 0.07 |
| Layer 15: Interlayer | |
| Fine silver iodobromide grain (AgI = 2 mol %, homogeneous iodide type, sphere-equivalent diameter = 0.13 μm) coating silver amount | 0.2 |
| Gelatin | 0.36 |
| Layer 16: 3rd blue-sensitive emulsion layer | |
| Silver iodobromide emulsion III coating silver amount | 1.55 |
| Gelatin | 0.5 |
| ExY-1 | 0.2 |
| Solv-1 | 0.07 |
| Layer 17: 1st protective layer | |
| Gelatin | 1.8 |
| UV-1 | 0.1 |
| UV-2 | 0.2 |
| Solv-1 | 0.01 |
| Solv-2 | 0.01 |
| Layer 18: 2nd protective layer | |
| Fine silver chloride grain (sphere-equivalent diameter = 0.07 μm) coating silver amount | 0.36 |
| Gelatin | 0.7 |
| Polymethylmethacrylate grain (diameter = 1.5 μm) | 0.2 |
| W-1 | 0.02 |
| H-1 | 0.4 |
| Cpd-7 | 1.0 |

In addition to the above compounds, B-1 (a total of 0.20 g/m$^2$), 1,2-benzisothiazoline-3-one (about 200 ppm on the average with respect to gelatin), n-butyl-p-hydroxybenzoate (about 1,000 ppm on the average with respect to gelatin), and 2-phenoxyethanol (about 10,000 ppm on the average with respect to gelatin) were added to each layer.

Formulas or names of the compounds used in the manufacture of the samples are listed in Table B.

The emulsions M-3 to R-3, M-2 to R-2, and M-1 to R-1 were used as the silver iodobromide emulsions I, II, and III of the layers 5, 10, and 16 to prepare multilayered color light-sensitive materials 301 to 306 as listed in the following table.

| Sample name | Layer name | Emulsion name |
|---|---|---|
| Sample 301 | Layer 5 | M-3 |
| (Comparative | Layer 10 | M-2 |
| Example) | Layer 16 | M-1 |
| Sample 302 | Layer 5 | N-3 |
| (Comparative | Layer 10 | N-2 |
| Example) | Layer 16 | N-1 |
| Sample 303 | Layer 5 | O-3 |
| (Comparative | Layer 10 | O-2 |
| Example) | Layer 16 | O-1 |
| Sample 304 | Layer 5 | P-3 |
| (Present | Layer 10 | P-2 |
| Invention) | Layer 16 | P-1 |
| Sample 305 | Layer 5 | Q-3 |
| (Present | Layer 10 | Q-2 |
| Invention) | Layer 16 | Q-1 |
| Sample 306 | Layer 5 | R-3 |
| (Present | Layer 10 | R-2 |
| Invention) | Layer 16 | R-1 |

The samples 301 to 306 were left to stand at a temperature of 40° C. and a relative humidity of 70% for 14 hours and then subjected to sensitmetry exposure (1/100") and the following color development process.

The processed samples were subjected to density measurement by using red, green, and blue filters. The measurement results are summarized in Tables 3-1 to 3-3.

In addition, another two sets of the samples 301 to 306 left to stand at a temperature of 40° C. and a relative humidity of 70% for 14 hours were prepared. One set of the samples was left to stand at a temperature of 25° C. and a relative humidity of 60% for 6 months. Another set of the samples was left to stand at a temperature of 60° C. and a relative humidity of 60% for 7 days. These samples were subjected to sensitometry exposure (1/100") and the following color development.

The processed samples were subjected to density measurement by using red, green, and blue filters. The measurement results are summarized in Tables 3-1 to 3-3.

Of the above results of photographic properties, sensitivity is represented by relative sensitivity assuming that the sensitivity (fog+optical density of 0.2) of the sample 301 was 100.

Processing Method

The color development process was performed at 38° C. in accordance with the following process steps.

| | |
|---|---|
| Color development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The processing solution compositions used in the respective steps were as follows.

| | |
|---|---|
| Color development solution | |
| Diethylenetriaminepentaacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |

-continued

| | |
|---|---|
| 4-(N-ethyl-N-β-hydroxyethylamino)-2-methylanilinesulfate | 4.5 g |
| Water to make | 1.0 l |
| pH | 10.0 |
| Bleaching Solution | |
| Ferric ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| Fixing solution | |
| Disodium ethylenediaminetetraacetate | 1.0 g |
| Sodium sulfite | 4.0 g |
| Ammonium thiosulfate aqueous solution (70%) | 175.0 ml |
| Sodium bisulfite | 4.6 g |
| Water to make | 1.0 l |
| pH | 6.6 |
| Stabilizing solution | |
| Formalin (40%) | 2.0 ml |
| Polyoxyethylene-p-monononyl-phenylether (average polymerization degree = 10) | 0.3 g |
| Water to make | 1.0 l |

TABLE 3-1

| | Fog and sensitivity of Blue Layer | | | | | |
|---|---|---|---|---|---|---|
| | 40° C., 70%, 14 Hours | | 25° C., 60%, 6 Months | | 60° C., 60%, 7 Days | |
| Sample No. | Fog | Sensitivity | Fog | Sensitivity | Fog | Sensitivity |
| Sample 301 (Comparative Example) | 0.98 | 100 | 1.06 | 71 | 1.16 | 78 |
| Sample 302 (Comparative Example) | 1.13 | 123 | 1.21 | 72 | 1.29 | 76 |
| Sample 303 (Comparative Example) | 0.98 | 103 | 1.01 | 70 | 1.17 | 76 |
| Sample 304 (Present Invention) | 0.98 | 132 | 1.02 | 117 | 1.08 | 121 |
| Sample 305 (Present Invention) | 1.00 | 144 | 1.03 | 134 | 1.09 | 144 |
| Sample 306 (Present Invention) | 1.00 | 152 | 1.03 | 149 | 1.09 | 152 |

TABLE 3-2

| | Fog and sensitivity of Green Layer | | | | | |
|---|---|---|---|---|---|---|
| | 40° C., 70%, 14 Hours | | 25° C., 60%, 6 Months | | 60° C., 60%, 7 Days | |
| Sample No. | Fog | Sensitivity | Fog | Sensitivity | Fog | Sensitivity |
| Sample 301 (Comparative Example) | 0.66 | 100 | 0.71 | 63 | 0.78 | 69 |
| Sample 302 (Comparative Example) | 0.76 | 155 | 0.82 | 62 | 0.87 | 66 |
| Sample 303 (Comparative Example) | 0.66 | 101 | 0.72 | 61 | 0.79 | 66 |
| Sample 304 (Present Invention) | 0.66 | 123 | 0.68 | 105 | 0.72 | 110 |
| Sample 305 (Present Invention) | 0.67 | 132 | 0.69 | 120 | 0.72 | 129 |

TABLE 3-2-continued

| | Fog and sensitivity of Green Layer | | | | | |
|---|---|---|---|---|---|---|
| | 40° C., 70%, 14 Hours | | 25° C., 60%, 6 Months | | 60° C., 60%, 7 Days | |
| Sample No. | Fog | Sensitivity | Fog | Sensitivity | Fog | Sensitivity |
| Sample 306 (Present Invention) | 0.67 | 135 | 0.69 | 128 | 0.72 | 133 |

TABLE 3-3

| | Fog and sensitivity of Red Layer | | | | | |
|---|---|---|---|---|---|---|
| | 40° C., 70%, 14 Hours | | 25° C., 60%, 6 Months | | 60° C., 60%, 7 Days | |
| Sample No. | Fog | Sensitivity | Fog | Sensitivity | Fog | Sensitivity |
| Sample 301 (Comparative Example) | 0.37 | 100 | 0.45 | 66 | 0.54 | 72 |
| Sample 302 (Comparative Example) | 0.55 | 112 | 0.64 | 64 | 0.72 | 69 |
| Sample 303 (Comparative Example) | 0.37 | 101 | 0.44 | 62 | 0.55 | 68 |
| Sample 304 (Present Invention) | 0.38 | 120 | 0.42 | 105 | 0.47 | 110 |
| Sample 305 (Present Invention) | 0.39 | 129 | 0.43 | 120 | 0.47 | 128 |
| Sample 306 (Present Invention) | 0.39 | 132 | 0.43 | 122 | 0.47 | 129 |

As is apparent from the results shown in Tables 3-1 to 3-3, even in a multilayered color light-sensitive material, high sensitivity and improved storage stability at around room temperature for a long time period or upon application of heat and humidity, are attained by the present invention.

EXAMPLE 4

The samples 301 to 306 of the present invention and the comparative examples are used to conduct an experiment following the same procedures as in Example 3 except for the following processing method. Color development process is performed by using an automatic developing machine in accordance with the following method.

| Processing Method | | |
|---|---|---|
| Step | Time | Temperature |
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Drying | 1 min. 15 sec. | 55° C. |

The processing solution compositions will be described below.

| (Color developing solution) | (g) |
|---|---|
| Diethylenetriaminepentaacetic acid | 1.0 |
| 1-hydroxyethylidene-1,1-diphosphonic acid | 3.0 |
| Sodium sulfite | 4.0 |

-continued

| | |
|---|---|
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Water to make | 1.0 l |
| pH | 10.05 |
| (Bleaching solution) | (g) |
| Ferric ammonium ethylenediaminetetraacetate (dihydrate) | 120.0 |
| Disodium ethylenediaminetetraacetate | 10.0 |
| Ammonium bromide | 100.0 |
| Ammonium nitrate | 10.0 |
| Bleaching accelerator | 0.005 mol |

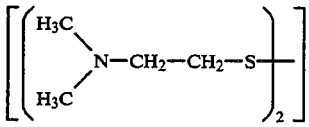

| | |
|---|---|
| Aqueous Ammonia (27%) | 15.0 ml |
| Water to make | 1.0 l |
| pH | 6.3 |
| (Bleach-fixing solution) | (g) |
| Ferric ammonium ethylenediaminetetraacetate (dihydrate) | 50.0 |
| Disodium ethylenediaminetetraacetate | 5.0 |
| Sodium sulfite | 12.0 |
| Ammonium thiosulfate aqueous solution (70%) | 240.0 ml |
| Aqueous Ammonia (27%) | 6.0 ml |
| Water to make | 1.0 l |
| pH | 7.2 |

(Washing Solution)

Tap water is supplied to a mixed-bed column filled with an H type strongly acidic cation exchange resin (Amberlite IR-120B: available from Rohm & Haas Co.) and an OH type anion exchange resin (Amberlite IR-400) to set the concentrations of calcium and magnesium ions to be 3 mg/l or less. Subsequently, 20 mg/l of sodium dichloroisocyanurate and 1.5 g/l of sodium sulfate are added. The pH of the solution falls within the range of 6.5 to 7.5.

| (Stabilizing solution) | (g) |
|---|---|
| Formalin (37%) | 2.0 ml |
| Polyoxyethylene-p-monononyl phenylether (average polymerization degree = 10) | 0.3 |
| Disodium ethylenediaminetetraactate | 0.05 |
| Water to make | 1.0 l |
| pH | 5.0 to 8.0 |

The effect of the present invention could be obtained well in this processing as in Example 3.

EXAMPLE 5

The samples 301 to 306 of the present invention and the comparative examples were used to conduct an experiment following the same procedures as in Example 3 and processed by using an automatic developing machine in accordance with the following method.

| Processing Method | | |
|---|---|---|
| Step | Time | Temperature |
| Color development | 2 min. 30 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The processing solution compositions will be described below.

| (Color developing solution) | (g) |
|---|---|
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Water to make | 1.0 l |
| pH | 10.05 |
| (Bleach-fixing solution) | (g) |
| Ferric ammonium ethylenediaminetetraacetate (dihydrate) | 50.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator | 0.01 mol |

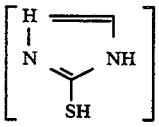

| | |
|---|---|
| Water to make | 1.0 l |
| pH | 6.0 |

(Washing Solution)

Tap water is supplied to a mixed-bed column filled with an H type strongly acidic cation exchange resin (Amberlite IR-120B: available from Rohm & Haas Co.) and an OH type anion exchange resin (Amberlite IR-400) to set the concentrations of calcium and magnesium ions to be 3 mg/l or less. Subsequently, 20 mg/l of sodium isocyanuric acid dichloride and 1.5 g/l of sodium sulfate are added. The pH of the solution falls within the range of 6.5 to 7.5.

| (Stabilizing solution) | (g) |
|---|---|
| Formalin (37%) | 2.0 ml |
| Polyoxyethylene-p-monononyl-phenylether (average polymerization degree = 10) | 0.3 |
| Disodium ethylenediaminetetraacetate | 0.05 |
| Water to make | 1.0 l |
| pH | 5.0 to 8.0 |

The effect of the present invention is also obtained by this processing method, as in Example 3.

TABLE A
(1-1) $CH_3SO_2SNa$
(1-2) $C_2H_5SO_2SNa$
(1-3) $C_3H_7SO_2SK$
(1-4) $C_4H_9SO_2SLi$
(1-5) $C_6H_{13}SO_2SNa$
(1-6) $C_8H_{17}SO_2SNa$
(1-7) $CH_3(CH_2)_3CH(C_2H_5)CH_2SO_2S.NH_4$
(1-8) $C_{10}H_{21}SO_2SNa$
(1-9) $C_{12}H_{25}SO_2SNa$
(1-10) $C_{16}H_{33}SO_2SNa$
(1-11) $(CH_3)_2CH-SO_2SK$
(1-12) $t\text{-}C_4H_9OS_2SNa$
(1-13) $CH_3OCH_2CH_2SO_2S.Na$
(1-14)
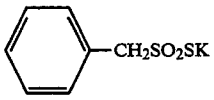
(1-15) $CH_2{=}CHCH_2SO_2SNa$
(1-16)
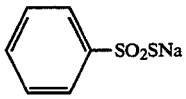
(1-17)
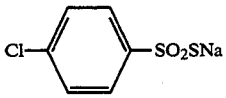
(1-18)
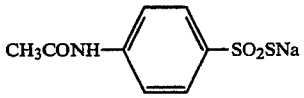
(1-19)
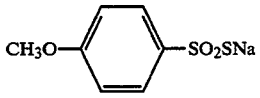
(1-20)
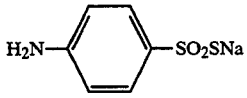
(1-21)
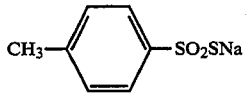
(1-22)
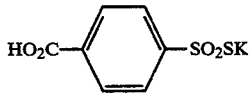
(1-23)
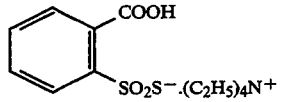
TABLE A-continued
(1-24)
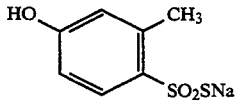
(1-25)
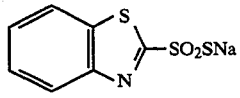
(1-26)
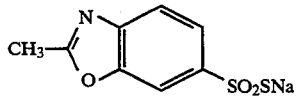
(1-27)
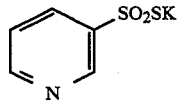
(1-28)
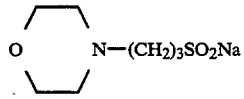
(1-29) $KSSO_2(CH_2)_2SO_2SK$
(1-30) $NaSSO_2(CH_2)_4SO_2SNa$
(1-31) $NaSSO_2(CH_2)_4S(CH_2)_4SO_2SNa$
(1-32)
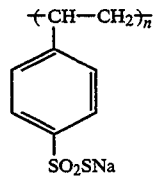
(1-33)
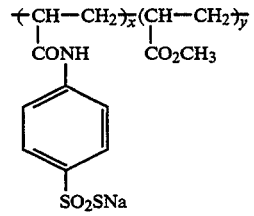
x:y = 1/1 (mole ratio)
(2-1) $C_2H_5SO_2S{-}CH_3$
(2-2) $C_8H_{17}SO_2SCH_2CH_3$
(2-3)
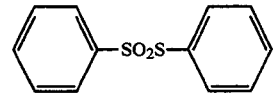
(2-4)
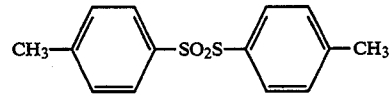
(2-5) $C_2H_5SO_2SCH_2CH_2CN$
(2-6)
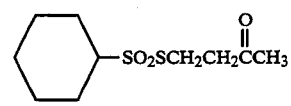
(2-7) $C_4H_9SO_2S(CH_3)CHCH_2CN$ TABLE A-continued
(2-8)
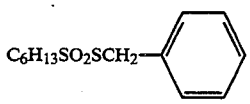
(2-9)
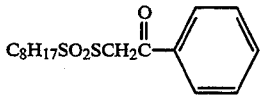
(2-10)
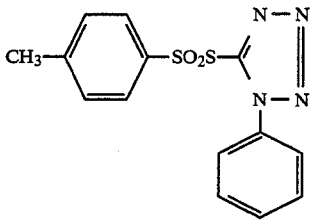
(2-11)
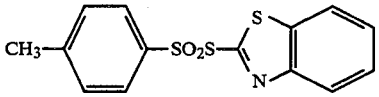
(2-12)
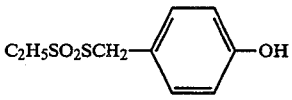
(2-13)
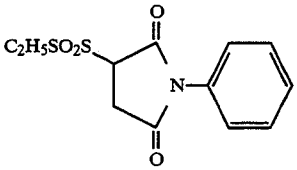
(2-14)
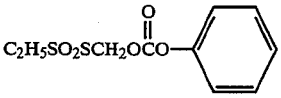
(2-15)
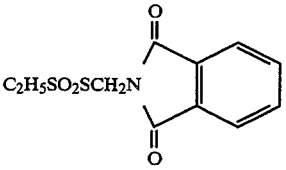
(2-16)
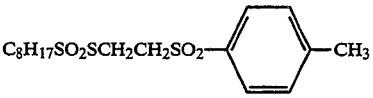
(2-17)
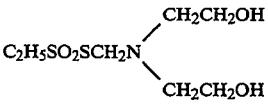
(2-18) $C_2H_5SO_2SCH_2CH_2CH_2CH_2OH$
(2-19)
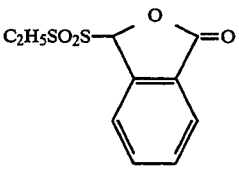
(2-20)
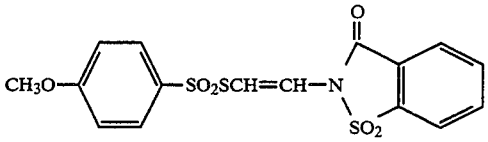
(2-21) $CH_3SSO_2(CH_2)_4SO_2SCH_3$
(2-22) $CH_3SSO_2(CH_2)_2SO_2SCH_3$
(2-23)
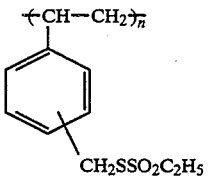
(2-24)
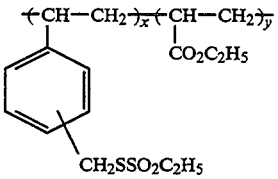
x:y = 2/1 (mole ratio)
(2-25) $(CH_2)_4$
$SO_2.S$
(3-1)
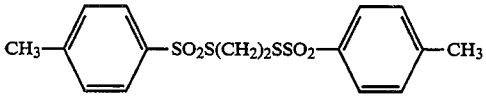
(3-2) $C_2H_5SO_2SCH_2CH_2SO_2CH_2CH_2SSO_2C_2H_5$
(3-3)
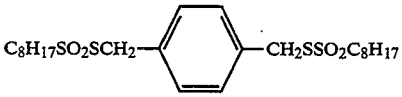
(3-4)
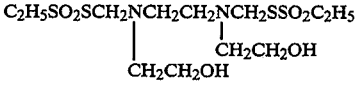
(3-5)
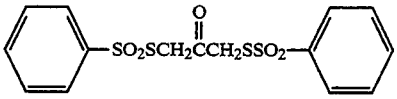
(3-6)
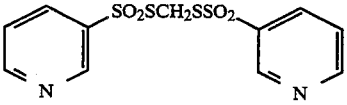
(3-7) $C_2H_5SO_2SSSO_2C_2H_5$
(3-8) $(n)C_3H_7SO_2SSSO_2C_3H_7(n)$
(3-9)
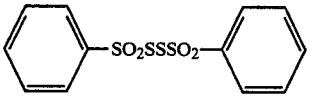

TABLE B
UV-1:
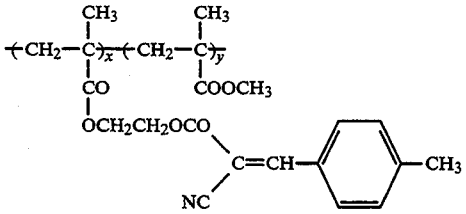
x/y = 7/3 (weight ratio)
UV-2:
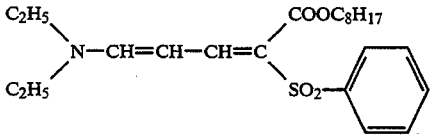
ExC-1
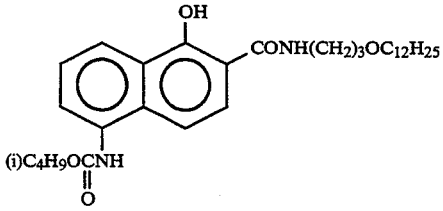
ExC-2
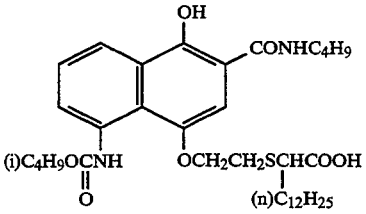
ExC-3
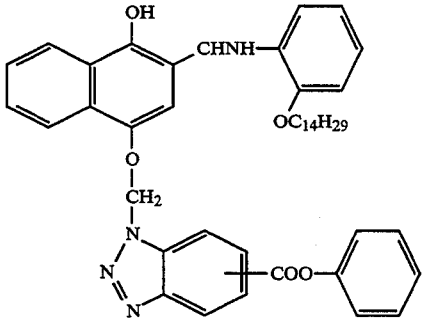
ExC-4
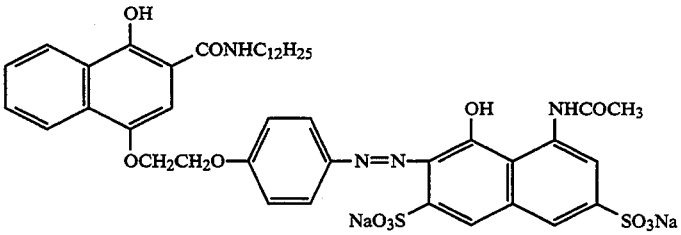
ExC-5
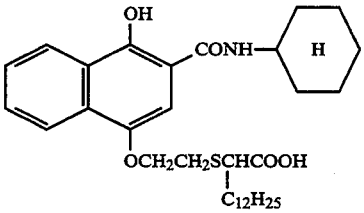

TABLE B-continued
ExM-1
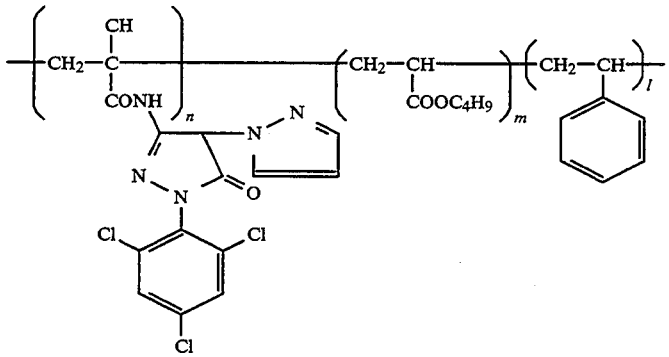
n:m:l = 2:1:2 (weight ratio)
mean molecular Weight 40,000
ExM-2
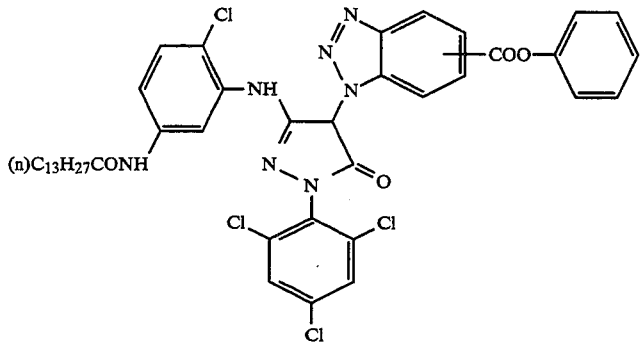
ExM-3
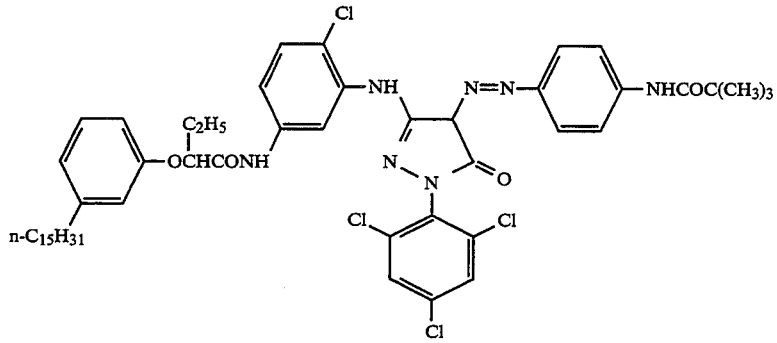
ExM-4
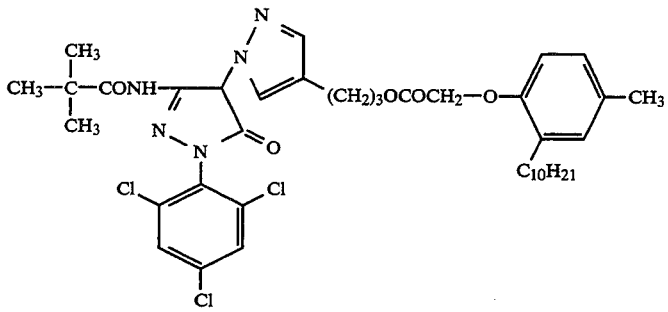

TABLE B-continued
ExM-5
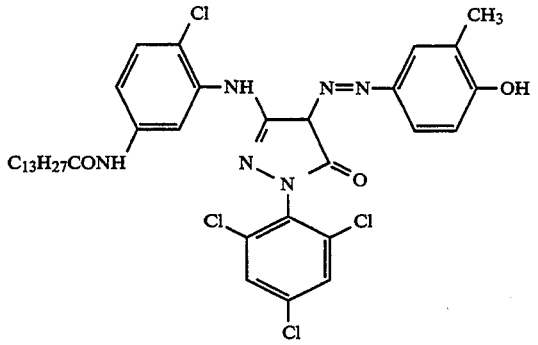
ExM-6
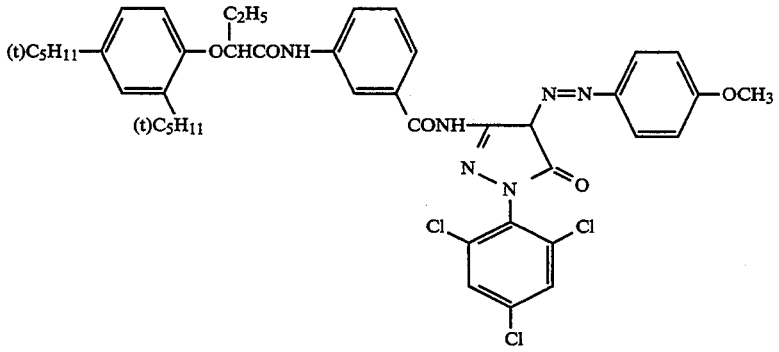
ExY-1
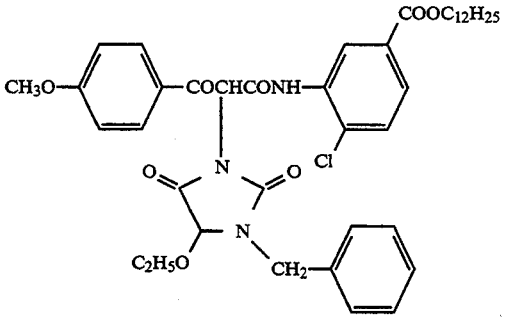
ExY-2
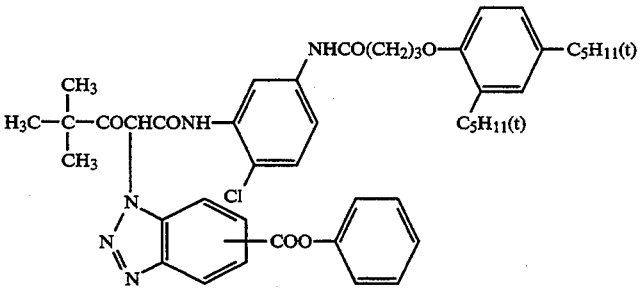
Cpd-1
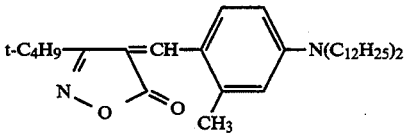

TABLE B-continued
Cpd-2
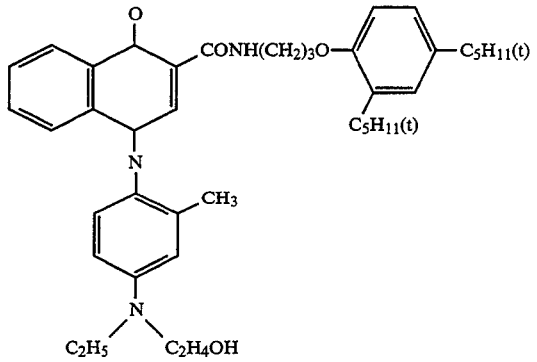
Cpd-3
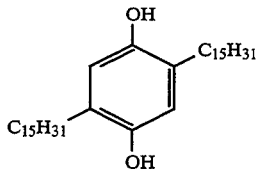
Cpd-4
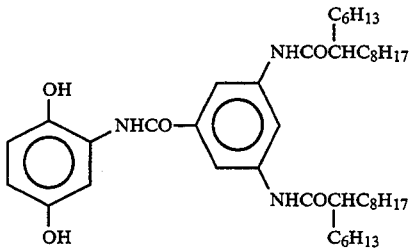
Cpd-5
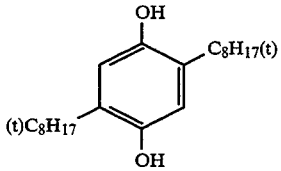
Cpd-6
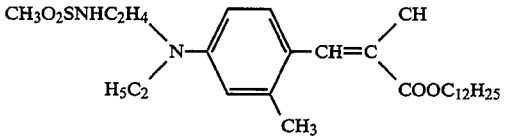
Cpd-7
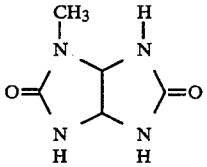
W-1
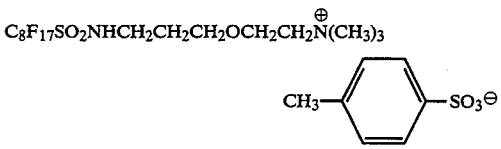
H-1
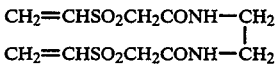

TABLE B-continued
B-1
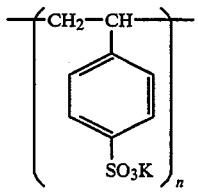
Solv-1
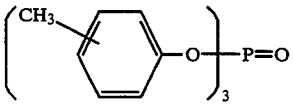
Solv-2
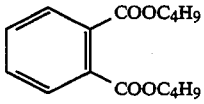
Solv-4
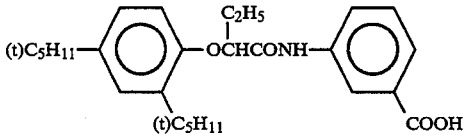
ExS-1
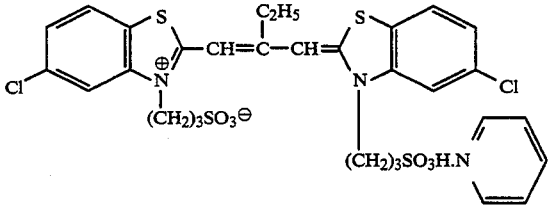
ExS-2
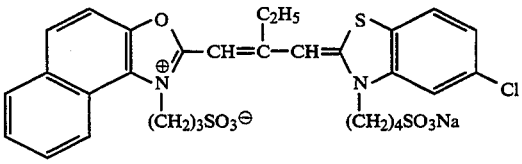
ExS-3
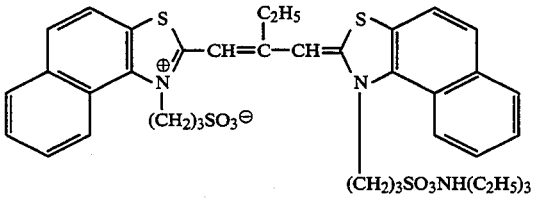
ExS-5
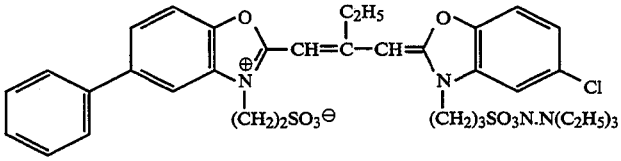
ExS-6
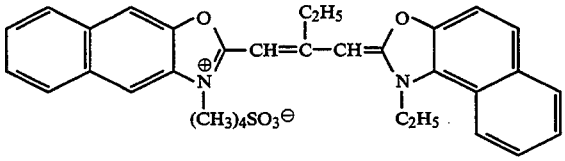

TABLE B-continued

ExS-7

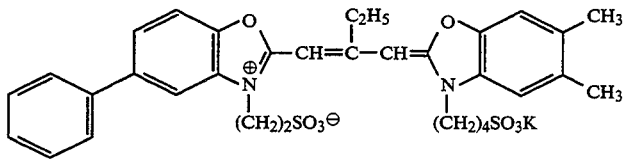

ExS-8

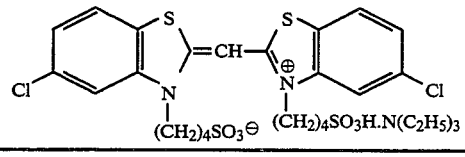

What is claimed is:

1. A negative silver halide emulsion containing light-sensitive silver halide grains in a binder, wherein said silver halide emulsion has been subjected to reduction-sensitization during grain formation and at least one compound represented by the following formula (I), (II), or (III) is added after reduction sensitization is started and 80% of total water-soluble silver salt required for the formation of silver halide grain are added:

$$R—SO_2S—M \quad (I)$$

$$R—SO_2S—R^1 \quad (II)$$

$$R—SO_2S—Lm\text{-}SSO_2—R^2 \quad (III)$$

wherein R, $R^1$, and $R^2$ may be the same or different and represent an aliphatic group, an aromatic group, or a heterocyclic group, M represents a cation, L represents a divalent bonding group, and m represents 0 or 1.

2. A silver halide photographic light-sensitive material having at least one silver halide emulsion layer on a support, wherein said emulsion layer contains at least one silver halide emulsions according to claim 1.

3. The silver halide emulsion according to claim 1, wherein said reduction sensitization is performed by using a reduction sensitizer selected from the group consisting of thiourea dioxide, dimethylamineborane, and ascorbic acid derivatives.

4. The silver halide emulsion according to claim 1, wherein said reduction sensitization is performed by high pH ripening method and/or Ag ripening method.

5. The silver halide emulsion according to claim 1, wherein R, $R^1$ and $R^2$ in the formula (I), (II) and (III) are an alkyl group having 1 to 22 carbon atoms or an aromatic group having 6 to 20 carbon atoms.

6. The silver halide emulsion according to claim 1, wherein the silver halide emulsion comprises regular crystal silver halide grains.

7. The silver halide emulsion according to claim 1, wherein the silver halide emulsion comprises tabular silver halide grains having an aspect ratio of 2 or more.

8. The silver halide emulsion according to claim 7, wherein the silver halide emulsion comprises tabular silver halide grains having an aspect ratio of 3 to 20.

9. The silver halide emulsion according to claim 1, wherein at least one compound represented by formula (I), (II), or (III) is added after reduction sensitization is started and 90% of total water-soluble silver salt are added and before a desalting step.

10. The silver halide emulsion according to claim 1, wherein the heterocyclic group of R, $R^1$ and $R^2$ is a 3- to 15-membered ring having at least one element of nitrogen, oxygen, sulfur, selenium, and tellurium and at least one carbon atom.

11. The silver halide emulsion according to claim 1, wherein L is a divalent aliphatic group or a divalent aromatic group.

12. The silver halide emulsion according to claim 1, wherein the compound represented by formula (I), (II), or (III) is added in an amount of $10^{-7}$ to $10^{-1}$ mol per mol of silver halide.

* * * * *